US006157795A

United States Patent [19]

Kadonaga et al.

[11] Patent Number: 6,157,795

[45] Date of Patent: Dec. 5, 2000

[54] IMAGE FORMING APPARATUS AND METHOD CONFIGURED TO REDUCE A TRANSFER CHARGE AT A NIP

[75] Inventors: Masami Kadonaga; Hiroyuki Sugimoto, both of Kanagawa, Japan

[73] Assignee: Ricoh Company, Ltd., Tokyo, Japan

[21] Appl. No.: 09/178,663

[22] Filed: Oct. 26, 1998

[30] Foreign Application Priority Data

| | | | |
|---|---|---|---|
| Oct. 27, 1997 | [JP] | Japan | 9-294669 |
| Nov. 21, 1997 | [JP] | Japan | 9-338047 |
| Jan. 9, 1998 | [JP] | Japan | 10-003131 |

[51] Int. Cl.[7] ..... G03G 15/14

[52] U.S. Cl. ..... 399/66; 399/302; 399/308

[58] Field of Search ..... 399/302, 308, 399/66, 297

[56] References Cited

U.S. PATENT DOCUMENTS

| | | | |
|---|---|---|---|
| 5,428,429 | 6/1995 | Fletcher | 399/308 |
| 5,778,291 | 7/1998 | Okubo et al. | 399/302 |
| 5,873,017 | 2/1999 | Soga et al. | 399/302 |
| 5,887,218 | 3/1999 | Yuu et al. | 399/302 X |
| 5,923,928 | 7/1999 | Sugimoto | 399/302 X |
| 5,926,669 | 7/1999 | Sugimoto et al. | 399/66 |
| 6,006,062 | 12/1999 | Takahashi et al. | 399/308 X |

FOREIGN PATENT DOCUMENTS

| | | |
|---|---|---|
| 195 02 098 | 11/1995 | Germany . |
| 195 23 767 | 1/1996 | Germany . |
| 197 13 389 | 11/1997 | Germany . |
| 8-272222 | 10/1996 | Japan . |
| 10-48970 | 2/1998 | Japan . |
| 10-73999 | 3/1998 | Japan . |

*Primary Examiner*—Fred L. Braun

*Attorney, Agent, or Firm*—Oblon, Spivak, McClelland, Maier & Nuestadt, P.C.

[57] ABSTRACT

An image forming apparatus and method thereof for reducing a transfer charge in a portion where an image carrier and a transfer body contact each other, and obviating the deterioration of images ascribable to Paschen discharge apt to occur at the end of the contact portion. A relationship exists between an image transfer nip, a discharge electrode and a transfer electrode of the image forming apparatus.

70 Claims, 13 Drawing Sheets

IMAGE FORMING APPARATUS AND METHOD CONFIGURED TO REDUCE A TRANSFER CHARGE AT A NIP

BACKGROUND OF THE INVENTION

The present invention relates to a copier, printer, facsimile apparatus or similar image forming apparatus and, more particularly, to an image forming apparatus of the type including an intermediate transfer device for transferring a toner image from a photoconductive element or similar image carrier to an intermediate transfer body by an electric field formed in a portion where the image carrier and transfer body contact each other.

An electrophotographic copier, printer or similar image forming apparatus capable of producing a color image by superposing toner images of different colors with an image transfer device is conventional. Generally, the image transfer device uses either one of a transfer drum system and an intermediate transfer body system. In the transfer drum system, a paper or similar recording medium is wrapped around a film fitted on a transfer drum, and toner images of different colors are sequentially transferred from a photoconductive element or image carrier to the recording medium one above the other. Because the recording medium must be electrostatically retained on the film, the film is formed of an insulator.

The intermediate transfer body system is such that toner images of different colors are directly transferred from a photoconductive element to an intermediate transfer body one above the other and then collectively transferred from the intermediate transfer body to a recording medium. Because the recording medium does not have to be wrapped around the intermediate transfer body, the transfer body can be formed of a material having a medium resistance (volume resistivity of $10^7$ Ωcm to $10^{14}$ Ωcm) as distinguished from an insulator. A charge deposited on a material having a medium resistance naturally attenuates with a preselected time constant. The image transfer device with such an intermediate transfer body is therefore advantageous over the transfer drum type device in that it does not need discharging means for forcibly dissipating a transfer charge. This kind of image transfer device reduces ozone and saves power while achieving paper-free and full-page copy features.

However, the problem with the intermediate transfer body formed of a medium resistance material is that the resistance of such a material is irregular and apt to vary due to the varying environment and aging, rendering the transfer body electrically unstable. As a result, characters and lines transferred to the intermediate transfer body are sometimes blurred or otherwise defective due to the scattering of toner.

In light of the above, Japanese Patent Application Nos. 8-283210 and 9-150197 propose an image transferring method and an image forming apparatus capable of dissipating a transfer charge at a portion where the image carrier and intermediate transfer body contact each other (transfer nip). With such a method and apparatus, it is possible to effectively reduce the above defective images even when the intermediate transfer body is formed of a medium resistance material. However, a series of researches and experiments showed that a desired transfer efficiency was not achieved or transferred images were deteriorated, depending on transfer charge applying conditions and discharging conditions.

Technologies relating to the present invention are also disclosed in, e.g., Japanese Patent Laid-Open Publication Nos. 8-272222, 10-48970 and 10-73999.

SUMMARY OF THE INVENTION

It is therefore an object of the present invention to provide an image forming apparatus capable of reducing defective images more effectively and realizing a desirable transfer efficiency.

It is another object of the present invention to provide an image forming apparatus capable of effecting discharge by reducing a transfer charge in a portion where an image carrier and a transfer body contact each other, and obviating the deterioration of images ascribable to Paschen discharge apt to occur at the end of the above portion.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
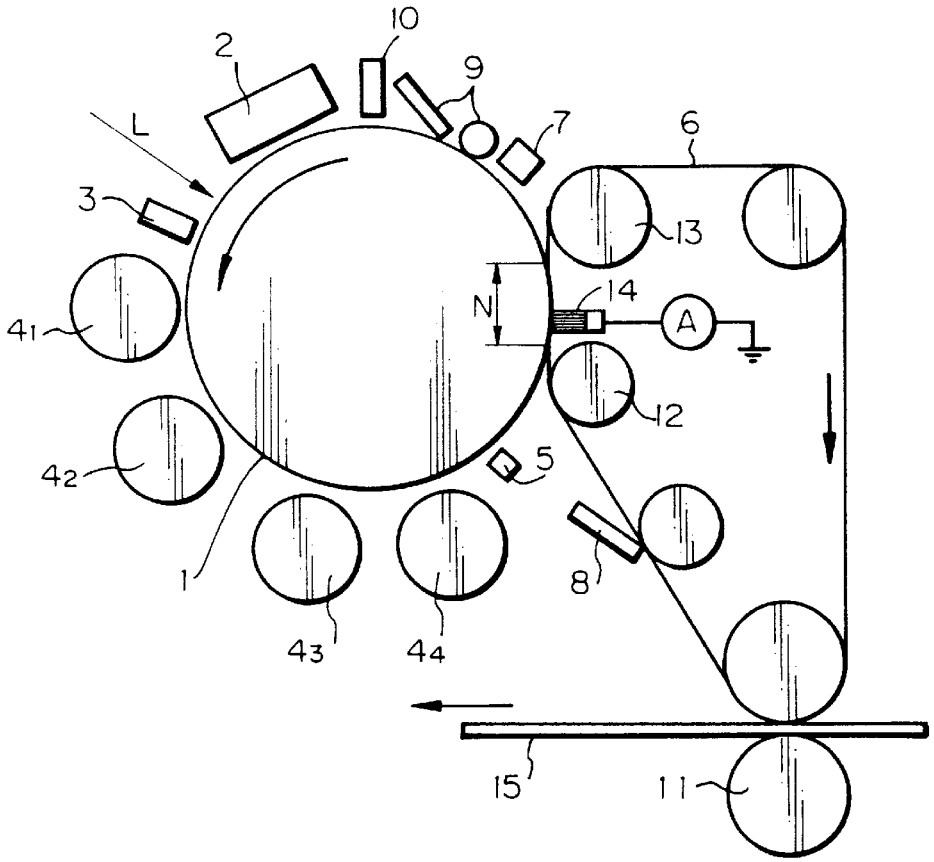
FIG. 1 shows an image forming apparatus embodying the present invention.

Preferred embodiments of the image forming apparatus in accordance with the present invention will be described hereinafter. It is to be noted that identical reference numerals used in the embodiments do not always designate identical structural elements.

Referring to FIG. 1 of the drawings, an image forming apparatus embodying the present invention, particularly an image forming section thereof, is shown. As shown, the image forming section includes a photoconductive element implemented as a drum 1. A charger 2, a potential sensor 3, four developing units $\mathbf{4}_1$–$\mathbf{4}_4$ each assigned to a particular color, a P (Pattern) sensor 5, an intermediate transfer belt 6, a precleaning charger (PCC) 7, a cleaning device 9 and a discharge lamp 10 are arranged around the drum 1. Let the developing units 41–44 facing the drum 1 be a black, a cyan, a magenta and a yellow developing unit, respectively. Toner images of different colors sequentially formed on the drum 1 are sequentially transferred to the intermediate transfer belt 6 one above the other. The resulting composite toner image, or color image, is transferred from the belt 6 to a paper or similar recording medium at a time.

The drum 1 is made up of a hollow cylindrical aluminum base and a separate function type photoconductive layer formed on the base. The photoconductive layer is a laminate of an under layer, a charge generation layer and a charge transport layer. The photoconductive layer has a thickness of 10 $\mu$m to 40 $\mu$m and a specific inductive capacity of about 3. In the illustrative embodiment, the charger 2 is implemented by a scorotron charger.

An image forming process particular to the illustrative embodiment will be outlined hereinafter. After the drum 1 has been uniformly charged to the negative polarity (about −650 V to about −700 V) by the charger 2, a laser beam L scans the charged drum 1 in accordance with image information to thereby electrostatically form a latent image of −100 V to −500 V on the drum 1. The potential sensor 3 may sense the charge potential of the drum 1 and the potential of the exposed portion of the drum 1 in order to control the charging condition and exposing condition.

Each of the developing units $\mathbf{4}_1$–$\mathbf{4}_4$ stores a dry two-ingredient type developer of particular color and deposits negatively charged toner on the portions of the drum 1 where the potential has been lowered by exposure. This kind of development is generally referred to as reversal development. In the illustrative embodiment, a bias of about −500 V to −550 V is selected for development; an AC component may be superposed on the bias, if desired. The P sensor 5 is positioned downstream of the developing section and senses the amount of toner deposition in terms of an optical reflection. The output of the P sensor 5 may be used to control various process conditions. The toner images sequentially formed on the drum 1 are sequentially transferred to the belt 6. The toner used in the illustrative embodiment is amorphous and produced by milling to have a mean particle size of 6$\mu$ to 8.

The belt or transfer body 6 has a medium resistance and implemented as a single layer of fluorine resin in which carbon black is dispersed. The belt 6 has a thickness of 50 $\mu$m to 300 $\mu$m, a specific inductive capacity of about 11, and a volume resistivity Rv of $1\times10^7$ Ωcm to $1\times10^{11}$ Ωcm. For the belt 6, use may be made of any other suitable resin, e.g., polycarbonate. A transfer voltage is applied to the belt 6 by an indirect application scheme. Specifically, a portion of the belt 6 between an inlet roller 12 and an outlet roller 13 is held in contact with the drum 1. The inlet roller 12 is connected to ground while the outlet roller 13 is applied with a positive transfer voltage Vt. The transfer voltage Vt is output from a power source, not shown, and controlled by a control section. Let the transfer of a toner image from the drum 1 to the belt 6 be referred to as belt transfer.

After the belt transfer, the PCC 7 controls the amount of charge remaining on the drum 1. Then, the cleaning device 9 removes the toner remaining on the drum 1 with a brush and a blade. The discharge lamp 10 dissipates the charge remaining on the drum 1.

After the transfer of a toner image of a first color to the belt 6, a toner image of a second color is formed on the drum 1 and then transferred to the belt 6 over the toner image of the first color. The transfer voltage may be increased every time one toner image is transferred to the belt 6, if desired. As for a full color image, a black, a cyan, a magenta and a yellow toner image are sequential ly transferred to the belt 6 one above the other, and the resulting full color image is transferred to a paper 15 at a time. To transfer the full color toner from the belt 6 to the paper 15, a positive voltage is applied from a roller 11 to the rear of the paper 15. Let the transfer of the toner image from the belt 6 to the paper 15 be referred to as paper transfer; in this sense, the roller 11 will be referred to as a paper transfer roller 11 hereinafter. The toner left on the belt 6 after the paper transfer is removed by belt cleaning means 8.

While the intermediate transfer body may be implemented as a rigid drum, the belt 6 promotes free layout therearound and therefore the miniaturization of the apparatus more than a drum.

Figure 2:
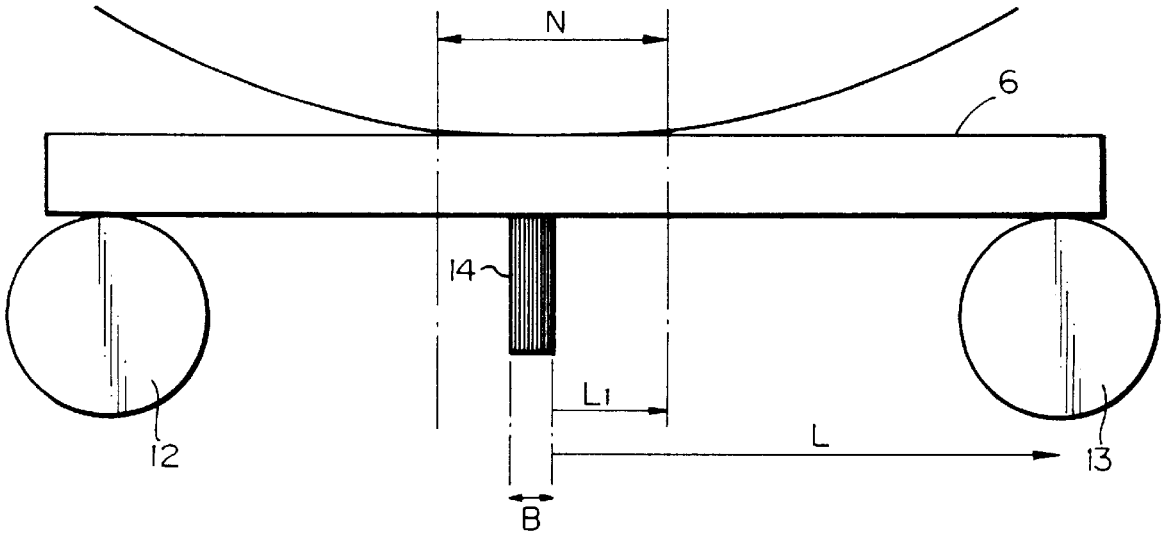
FIG. 2 is an enlarged view showing a belt transfer section included in the apparatus of FIG. 1.

FIG. 2 shows the belt transfer station in detail. As shown, in the illustrative embodiment, an electrode for dissipating a transfer charge is held in contact with at least a part of the rear of the transfer body (belt 6) within a transfer nip having a width N. The electrode is connected to ground or applied with a voltage opposite in polarity to the transfer bias in order to weaken an electric field for transfer at the inlet side of the nip. This successfully prevents the toner from flying about due to pretransfer. The electrode is implemented by a conductive brush 14 having a width B as measured in the direction or rotation of the belt 6. The brush 14 is held in contact with the rear of the belt 6 within the nip. Assume that the distance between the downstream end of the brush 14 in the direction of rotation of the belt 6 to the end of the nip is $L_1$, and that the distance between the downstream end of the brush 14 and the center of the outlet roller 13 is L.

To achieve a high transfer efficiency, the illustrative embodiment selects various factors including the position of the discharging electrode or brush 14, transfer bias, width N of the nip and volume resistivity of the belt 6 in such a manner as to satisfy conditions which will be described hereinafter.

Figure 3:
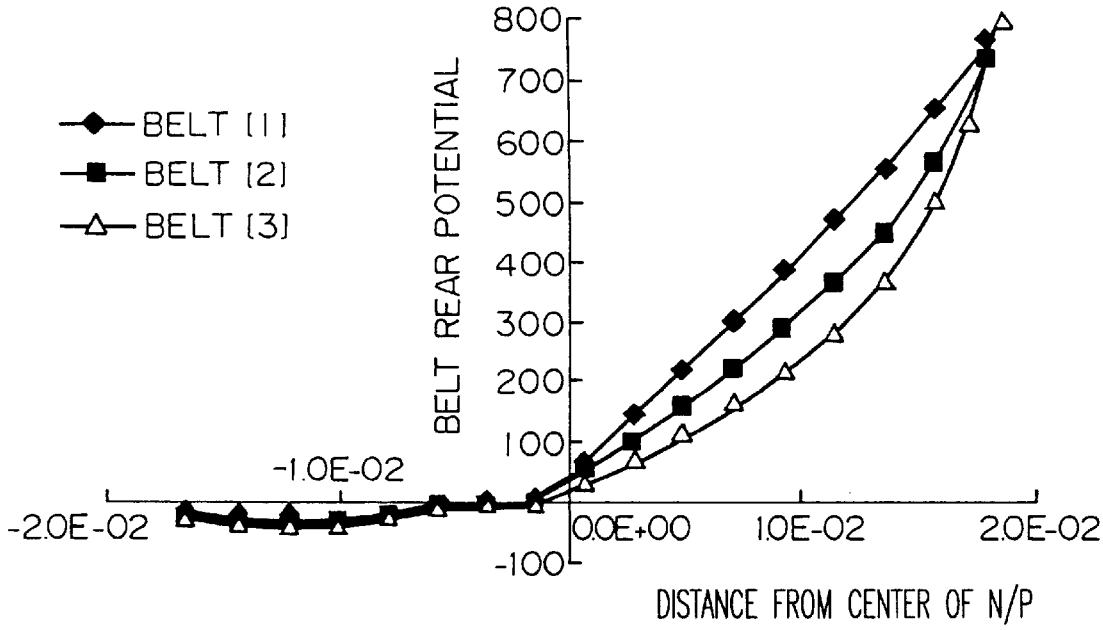
FIG. 3 is a graph showing potential distributions on the rears of transfer belts calculated by electric field simulations.

First, how a relation between the distance from the center of the nip and the potential on the rear of the belt 6 depends on the volume resistivity of the belt 6 will be described with reference to FIG. 3. FIG. 3 is a graph showing potential distribution on the rears of different belts calculated by electric field simulations. In FIG. 3, the abscissa has an origin representative of the center of the nip while the ordinate plots potentials on the rear of the belts. That is, how the potential on the rear of the belt 6 varies in accordance with the distance from the center of the nip is shown. For the simulations, the outlet roller 13 and inlet roller 12 were respectively spaced by distances of ±18 mm from the center of the nip. The nip was provided with a width N of 20 mm while a bias of 800 V was applied. The following three different kinds of belts were used for calculations:

belt [1]: volume resistivity Rv of $10^9$ Ωcm belt [2]: volume resistivity Rv of $10^{10}$ Ωcm belt [3]: volume resistivity Rv of $10^{11}$ Ωcm The brush 14 connected to ground was held in contact with the rear of each belt at a position of −5 mm to −1.4 mm on the X coordinate.

As FIG. 3 indicates, the potential on the rear of each belt changed little between the inlet roller 12 and the brush 14, but sequentially increased toward the outlet roller 13 without regard to the kind of the belt. As for the belt [1] having a low volume resistivity, the potential on the rear of the belt varies linearly from the downstream end of the brush 14 toward the out let roller or transfer bias roller 13. The potential on the rear of the belt varies along a curve of secondary degree as the volume resistivity increases.

Figure 4:
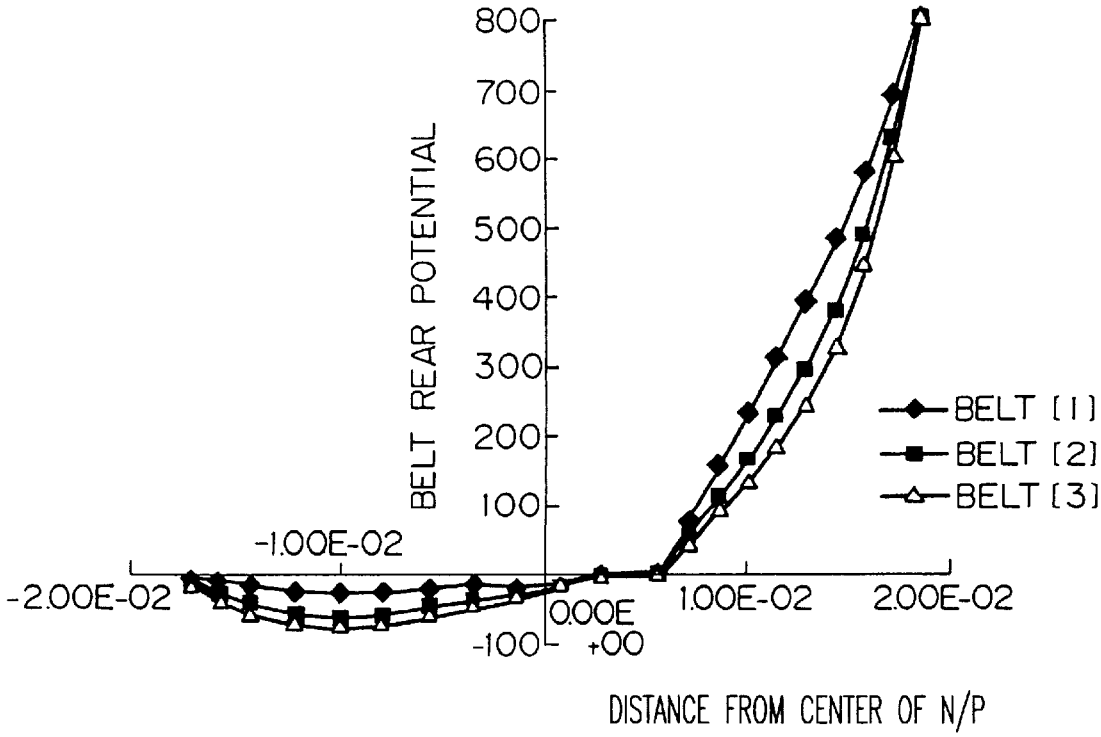
FIG. 4 is a graph showing potential distributions on the rears of belts with respect to different positions of a discharge brush.

FIG. 4 is a graph similar to FIG. 3 except that the brush 14 contacts the rear of the belt 6 at a position of +2 mm to +5.7 mm on the X coordinate. As shown, the potential on the rear of each belt also changed little between the inlet roller 12 and the brush 14, but sequentially increased toward the outlet roller 13 without regard to the kind of the belt. As for the belt [1] having a low volume resistivity, the potential on the rear of the belt varies linearly from the downstream end of the brush 14 toward the outlet roller or transfer bias roller 13. The potential on the rear of the belt varies along a curve of secondary degree as the volume resistivity increases.

Figure 5:
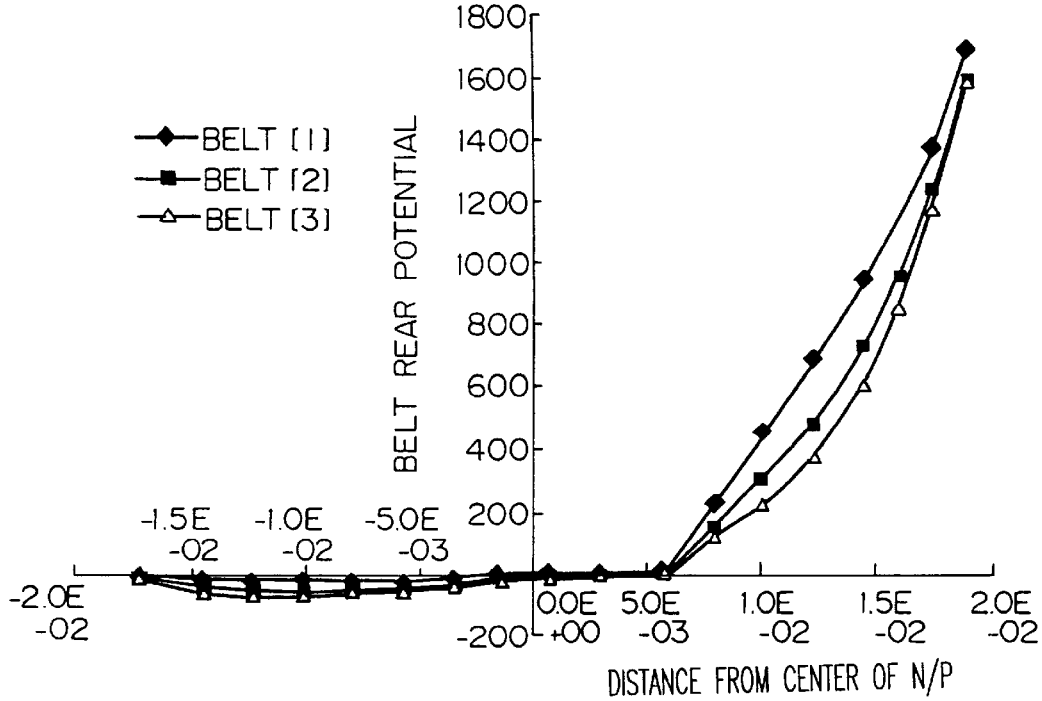
FIG. 5 is a graph showing potential distributions on the rears of belts with respect to different transfer biases.

FIG. 5 is a graph similar to FIG. 4 except that the transfer bias Vt is 1,600 V. As shown, the potential on the rear of each belt also changed little between the inlet roller 12 and the brush 14, but sequentially increased toward the outlet roller 13 without regard to the kind of the belt. As for the belt [1] having a low volume resistivity, the potential on the rear of the belt varies linearly from the downstream end of the brush 14 toward the outlet roller or transfer bias roller 13. The potential on the rear of the belt varies along a curve of secondary degree as the volume resistivity increases.

As FIGS. 3, 4 and 5 indicate, when the belt 6 has a low volume resistivity, the potential on the rear of the belt 6 varies linearly from the downstream end of the brush 14 to the outlet roller 13. The potential varies along a curve of secondary degree when the volume resistivity increases.

Further simulations effected with different calculation conditions proved that in the range of calculated belt resistances, the influence of the resistance of the belt and the positions of the rollers and brush was predominant over the influence of the amount of charge of toner and the surface potential of the photoconductive drum.

Figure 6:
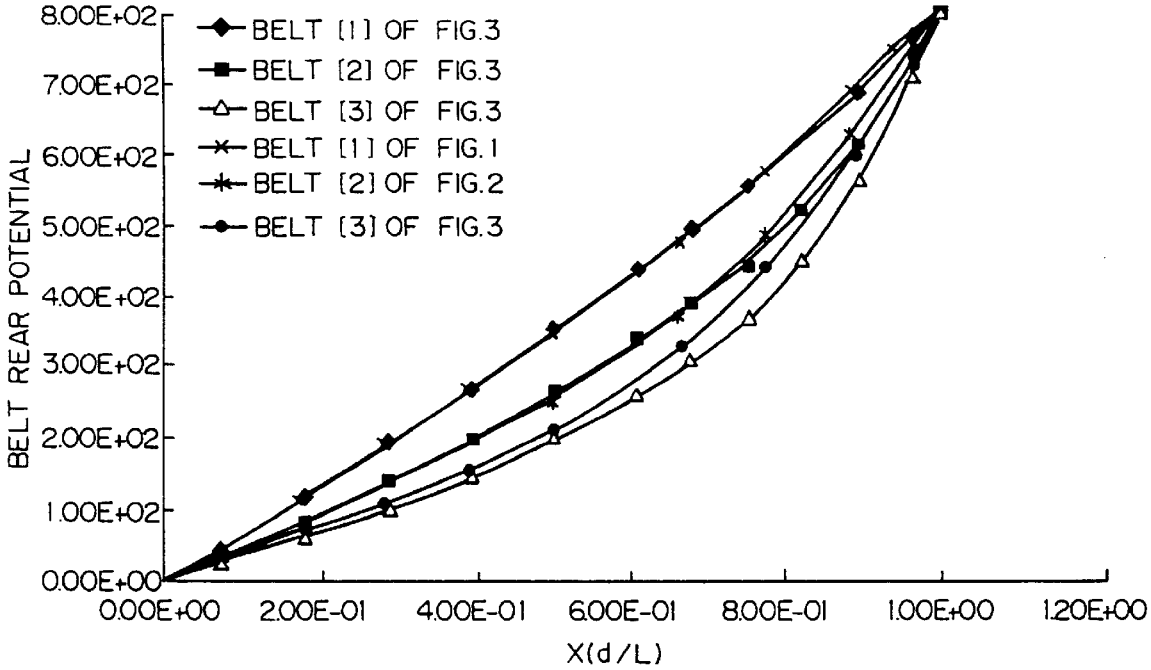
FIG. 6 is a graph re-plotting the potential distributions of FIGS. 3 and 4 in a portion downstream of the discharge brush.

Assume that a distance between the downstream end of the brush 14 and the outlet roller 13 is L, that a distance measured from the downstream end of the brush 14 is d, and that an equation X=d/L holds. FIG. 6 re-plots potential distributions on the rears of the belts downstream of the brush 14 under the above conditions. The transfer bias is assumed to be 800 V. As FIG. 6 indicates, the potential on the rear of the belt 6 remains substantially the same for X=d/L without regard to the position of the brush14. Specifically, in FIG. 6, the belt [1] of FIG. 3 and the belt [1] of FIG. 4 have substantially the same potential on their rears. This is also true with the belts [2] and [3].

The transfer bias in FIG. 5 is 1,600 V which is double the transfer bias of FIG. 4 (800 V). However, by comparing FIGS. 4 and 5, it will be seen that the value on the ordinate, i.e., the potential on the rear of the belt 6 is also double the potential of FIG. 4. Thus, the potential on the rear of the belt 6 increases in proportion to the transfer bias.

The above study indicates that when the volume resistivity of the belt 6 lies in the range of from $10^9$ Ωcm to $10^{10}$ Ωcm, the potential Vb on the rear of the belt 6 may be approximated as:

$$Vb=Vt(a\cdot X2+b\cdot X)/800 \quad (1)$$

where Vt is the transfer bias, a is 500+300(logR−10), b is 300−300(logR−10), and X denotes d/L. The base of log is 10, i.e., $\log_{10}R$.

As the above equation (1) indicates, even when the brush 14 is positioned at any desired position in the nip having the width N, the potential distribution on the rear of the belt 6 can be calculated and allows an optimal transfer bias to be easily set.

When the volume resistance of the belt 6 is less than $10^9$ Ωcm, the potential on the rear of the belt 6 between the downstream end of the brush 14 and the outlet roller 13 can be fully approximated by a straight line, i.e., Vb=Vt d/L.

The potential on the rear of the belt 6 and image transferability are closely related to each other. Particularly, if the potential in the nip between the image carrier (drum 1) and the transfer body (belt 6) is high, then the electric field for image transfer is also intense. If the above potential is low, then the electric field and therefore image transfer ratio is reduced. To allow the toner to move toward the transfer body (belt 6) in the nip, the belt 6 must include, within the nip, a sufficiently broad range which is above $V_1$, as found by our past studies. $V_1$ is given by $V_1=250+V_L$ where $V_L$ is the surface potential of the image carrier (drum 1), as measured in the image area. When the potential or surface potential on the rear of the belt 6 in the nip is above $V_1$, an electric field necessary for image transfer is formed and causes the toner to move toward the belt 6.

Assume that the belt 6 has a volume resistivity of $10^9$ Ωcm to $10^{11}$ Ωcm, that the distance between the brush 14 and the outlet of the nip is $L_1$, and that the distance between the brush 14 and the outlet roller 13 is L (see FIG. 2). Then, the potential $Vb_1$ on the rear of the belt 6 at a position represented by $X_1=L_1/L$ is expressed as:

$$Vb_1=Vt(a\cdot X_1^2+b\cdot X_1)/800 \quad (2)$$

where Bt is a transfer bias, a is 500+300(logR−19), and b is 300−300(logR−10).

Because the toner is not transferred unless the potential $Vb_1$ at the output of the nip N is at least above $V_1$, the following relation holds:

$$250+V_L \leqq Vb_1 \quad (3)$$

In practice, a sufficient region which is above $V_1$ must exist in the nip, so that the above relation should be:

$$250+V_L<Vb_1 \quad (3)$$

Further, in practice, a sufficient image transfer ratio is not achievable unless a certain region where the potential on the rear of the belt 6 is above $V_1$ (effective transfer region hereinafter) exists in the nip. We found that the effective transfer region must extend over about 4 mm or more; it takes about 22 msec or more for the belt 6 to pass through such a region.

Assuming that X(=d/L) when the potential on the rear of the belt 6 is $V_1$ is $X_0$, then $X_0$ can be produced by producing X, as follows:

$$V_1=V_t(a\cdot X^2+b\cdot X)/800 \quad (4)$$

The above equation is rewritten as:

$$a \cdot Vt \cdot X^2 + b \cdot Vt \cdot X - 800 \cdot V_1 = 0$$

Because $$X_0 = [-b \cdot Vt + (b^2 \cdot Vt^2 + 3200 \cdot a \cdot Vt \cdot V_1)^{0.5}]/(2 \cdot a \cdot Vt)$$

the effective transfer region where the potential on the rear of the belt 6 is above $V_1$ is produced by:

$$(X_1 - X_0) \times L \text{ (mm)}$$

That is, sufficient image transfer is achievable when $(X_1 - X_0) \times L > 4$ (mm) holds.

Assuming that a period of time of $t_0$ is necessary for the belt 6 to pass through the above effective transfer region, then the period of time $t_0$ is expressed as:

$$t_0 (X_1 - X_0) \cdot L/Va \quad (5)$$

where Va denotes the linear velocity (mm/s) of the belt 6.

Because the period of time to must be longer than 22 msec, sufficient image transfer is effected if:

$$(X_1 - X_0) \cdot L/Va > 0.022 \text{ (sec)} \quad (6)$$

When the potential Vb on the rear of the belt 6 is excessively high, discharge occurs between the belt 6 and the drum 1 and degrades image transfer (excessive image transfer). Specifically, if the potential $Vb_1$ at the outlet of the nip is higher than $V_2$ produced by:

$$V_2 = 1200 + V_L$$

then excessive image transfer occurs, as also proved by out past studies.

Therefore, the following relation holds:

$$1200 + V_L \geqq Vb_1 \quad (7)$$

However, the above relation (7) is adaptive to a broad range of belt resistivities and therefore extremely loose when it comes the belt resistivity between $10^9$ Ωcm and $10^{11}$ Ωcm considered in the illustrative embodiment. Experiments to be described later indicates that an adequate range is:

$$700 + V_L \geqq Vb_1 > 400 + V_L$$

When the volume resistivity of the belt 6 is less than $10^9$ Ωcm, the potentials on the rear of the belt 6 from the downstream end of the brush 11 to the outlet roller or bias roller 13 can be fully approximated by a straight line, i.e., Vb=Vt·d/L, as stated earlier. Therefore, assuming that the distance between the brush or discharge electrode 14 and the outlet of the nip is $L_1$, and that the distance between the brush 14 and the outlet roller 13 is L (see FIG. 2), then the potential $Vb_1$ on the rear of the belt 6 at the position $X_1 = L_1/L$ is produced by:

$$Vb_1 = Vt \cdot X_1$$

Because the toner is not transferred unless the potential $Vb_1$ at at least the outlet of the nip is above $V_1$, the following relation holds:

$$250 + V_L < Vb_1 \quad (8)$$

In practice, the region where the potential exceeds $V_1$ must sufficiently extend in the nip, the above relation should be limited to:

$$250 + V_L < Vb_1$$

In practice, a sufficient transfer ratio is not achievable unless a certain effective transfer region exists in the nip, as stated earlier. The effective transfer region is greater than about 4 mm or above 22 msec in terms of a period of time necessary for the belt 6 to pass through the region.

$X_0$ when the potential on the rear of the belt 6 is $V_1$ is produced by:

$$X_0 = V_1/Vt \quad (9)$$

Therefore, the effective transfer region allowing the potential of $V_1$ or above to deposit on the rear of the belt 6 is expressed as:

$$(X_1 - X_0) \times L \text{ (mm)}$$

That is, sufficient image transfer is achievable when $(L_1/L - V_1/Vt) \cdot L > 4$ (mm) holds.

Assuming that a period of time of to is necessary for the belt 6 to pass through the above effective transfer region, then the period of time $t_0$ is expressed as:

$$t_0 = (X_1 - X_0) \cdot L/Va \quad (10)$$

where Va denotes the linear velocity (mm/s) of the belt 6.

Because the period of time $t_0$ must be longer than 22 msec, sufficient image transfer is effected if:

$$(L_1/L - V_1/Vt) \cdot L/Va > 0.022 \text{ (sec)}$$

When the potential Vb on the rear of the belt 6 is excessively high, discharge occurs between the belt 6 and the drum 1 and degrades image transfer (excessive image transfer). Specifically, if the potential $Vb_1$ at the outlet of the nip is higher than $V_2$ produced by:

$$V_2 = 1200 + V_L$$

then excessive image transfer occurs, as proved by out past studies.

Therefore, the following relation holds:

$$1200 + V_L \geqq Vb_1 \quad (11)$$

However, the above relation (11) is adaptive to a broad range of belt resistivities and therefore extremely loose when it comes the belt resistivity between $10^9$ Ωcm and $10^{11}$ Ωcm considered in the illustrative embodiment. Experiments to be described later indicates that an adequate range is:

$$700 + V_L \geqq Vb_1 \geqq 400 + V_L$$

As the belt 6 is used over a long period of time, the optimal bias for image transfer is apt to vary due to the deterioration of the belt resistance and the deterioration of the brush 14. In addition, the expected image transfer efficiency is sometimes not achieved due to irregularity in parts. On the other hand, in the transfer belt system, the image transfer efficiency noticeably varies in accordance with the position of the brush 14 for a given bias for image transfer, as discussed with reference to FIGS. 3–6.

When the image transfer efficiency varies due to, e.g., aging, it can be noticeably improved if the position of the brush 14 is slightly changed. It follows that an image forming apparatus capable of easily correcting its image transfer efficiency can be implemented if the position of the brush 14 is finely adjustable to the upstream side or the downstream side, as needed. The brush 14 should only be movable on the rear of the belt 6 over the nip width N. For example, the brush 14 may be slightly shifted to the upstream side in the case of defective image transfer or to the downstream side in the case of excessive transfer. This allows a desirable image transfer efficiently to be easily restored without varying the bias for image transfer.

Specific examples of the illustrative embodiment each satisfying the above conditions will be described hereinafter.

EXAMPLE 1

The drum 1 had a 28 $\mu$m thick photoconductive layer or film. The belt 6 was 150 $\mu$m thick and had a volume resistivity Rv of about $1\times10^{10}$ Ωcm. The belt 6 was moved at a velocity of 180 mm/s. The distance L, between the downstream end of the brush or discharge electrode 14 in the nip and the downstream end or outlet of the nip was 10 mm. The distance L between the downstream end of the brush 14 in the nip and the center of the roller 13 (contact portion of the bias electrode) was 18 mm.

The discharge electrode 14 was implemented by a conductive brush formed of acrylic fibers with carbon black dispersed therein. The conductive brush is capable of evenly contacting the rear of the belt 6 and reducing the required contact pressure. When the charge potential of the drum 1 was −650 V, when the bias for development was −500 V, when the potential of the exposed portion was −150 V, and when the charge deposited on the developer was about −15 $\mu$C/g, an amount of toner development of about 1.5 mg/cm$^2$ was achieved which implemented sufficient image density in a monocolor mode. Toner particles had a density of 1.2 g/cm$^3$ while the toner layer had a packing ratio of 0.42. The charge distribution of the toner particles was about $-3\times10^{-15}$ C on the average, as measured by E Spart Analyzer (trade name) available from Hosokawa Microns.

In the above conditions, the bias Vt guaranteeing transfer ratios above 90% inclusive was 700 V to 1,200 V. In this example, images with desirable transferability and causing a minimum of toner to be scattered around were achieved by controlling a bias power source, not shown, such that the bias of 800 V was output.

EXAMPLE 2

Example 1 was repeated except that the volume resistivity Rv of the belt 6 was $1\times10^{11}$ Ωcm one figure higher than in Example 1. The bias Vt guaranteeing image transfer ratios above 90% inclusive was 900 V to 1,650 V. Images with desirable transferability and causing a minimum of toner to be scattered around were achieved by controlling the bias power source such that the bias of 1,050V was output.

EXAMPLE 3

Example 1 was repeated except that the volume resistivity Rv of the belt 6 was 1×108 Ωcm two figure lower than in Example 1. The bias Vt guaranteeing image transfer ratios above 90% inclusive was 530 V to 860 V.

EXAMPLE 4

Example 1 was repeated except for the position of the brush 14. In Example 4, the brush 14 was shifted to the upstream side, i.e., toward the inlet roller 12. The distance $L_1$ between the downstream end of the brush 14 and the outlet of the nip was 17 mm while the distance L between the downstream end of the brush 14 and the center of the outlet roller 113 was 25 mm. The bias Vt guaranteeing transfer ratios above 90% inclusive was 420 V to 880 V. Images causing a minimum of toner to be scattered around were achieved as in Example 1.

EXAMPLE 5

Example 1 was repeated except for the width N of the nip between the drum 1 and the belt 6. In Example 5, the bias for image transfer was selected to be 800 V. A change in the nip width N caused the distance $L_1$ between the downstream end of the brush 14 and the outlet of the nip to change. Specific transfer ratios implemented by various distances $L_1$ are listed in Table 1 shown below. Also listed in Table 1 are the widths X of the effective transfer region which deposit potentials above $250+V_L=100$ V on the rear of the belt 6. A width X deposited a potential of 100 V on the rear of the belt 6 was 0.25 and was about 4.5 mm remote from the downstream end of the brush 14.

TABLE 1

| $L_1$ (mm) | Transfer Ratio (%) | X (mm) |
|---|---|---|
| 2 | 34 | — |
| 4 | 45 | — |
| 6 | 72 | 1.5 |
| 8 | 88 | 3.5 |
| 9 | 91 | 4.5 |
| 10 | 96 | 5.5 |
| 14 | 95 | 9.5 |
| 16 | 94 | 11.5 |

Table 1 indicates that if the region where the potential above $250+V_L=100$ V deposits on the rear of the belt 6 is longer than 4 mm, then a sufficient transfer ratio is achievable. Such a length corresponds to a period of time of 4/180=0.0222 sec=22 msec necessary for the belt 6 to pass through the above region.

The conductive brush 14 used in the illustrative embodiment may be replaced with any other suitable discharge electrode. Also, the outlet roller 13 may be replaced with any other suitable bias applying means. Further, the inlet roller 12 may be replaced with any other suitable bias feedback means. Moreover, the number of developing units 4 is not limited to four, but may be, e.g., two for implementing bicolor images. Of course, the apparatus may be implemented as a copier, printer, etc.

As described above, in the above embodiment, a specific position of the discharge electrode, a specific bias for image transfer, a specific width of a nip between the image carrier and the transfer body (belt) and a specific resistance of the transfer body are determined. With such specific values, the embodiment obviates defective image transfer, ensures a sufficient image transfer ratio, and obviates excessive image transfer. Further, the embodiment easily corrects the variation of the transfer efficiency ascribable to aging, varying environment and irregularity in parts, thereby ensuring an optimal transfer efficiency. This can be done without effecting, e.g., a discharging ability.

An alternative embodiment of the present invention will be described with reference to FIG. 7. As shown, an image forming apparatus also includes a single photoconductive drum or image carrier 1. Toner images of different colors sequentially formed on the drum 1 are sequentially transferred to an intermediate transfer belt or transfer body 6 one above the other. The resulting composite toner image or color image is transferred from the belt 6 to a paper or similar recording medium at a time.

The drum 1 is made up of a hollow cylindrical aluminum base and a separate function type photoconductive layer or dielectric layer formed on the base. The photoconductive layer is a laminate of an under layer, a charge generation layer and a charge transport layer. The photoconductive layer has a thickness $\epsilon m$ of 10 $\mu$m to 40 $\mu$m and a specific inductive capacity em of about 3.2.

After the drum 1 has been uniformly charged by a scorotron charger or charging means 2 to the negative polarity (about −650 V to about −700 V), a laser beam L scans the charged drum 1 in accordance with image information to thereby electrostatically form a latent image of −100 V to −500 V on the drum 1. A potential sensor 3 senses the charge potential of the drum 1 and the potential of the exposed portion of the drum 1, so that the charging condition and exposing condition can be controlled.

Four developing units 6Bk, 6C, 6M and 6Y respectively storing black (Bk) toner, cyan (C) toner, magenta (M) toner and yellow (Y) toner are arranged in this order and face the drum 1. Each of the development units 6Bk–6Y develops a particular latent image formed on the drum 1. Specifically, each of the developing units 6Bk–6Y stores a dry two-ingredient type developer of particular color and deposits negatively charged toner on the portions of the drum 1 where the potential has been lowered by exposure (reversal development). In the illustrative embodiment, a bias of about −500 V to −550 V is selected for development; an AC component may be superposed on the bias, if desired. A reflection type optical sensor or image density sensing means 5 faces the surface portion of the drum 1 undergone development. The sensor 5 senses the amount of toner deposition in terms of an optical reflection. The output of the sensor 5 may be used to control various process conditions. The toner images sequentially formed on the drum 1 are sequentially transferred to the belt 6. The toner used in the illustrative embodiment is also amorphous and produced by milling to have a mean particle size of 6 $\mu$m to 8 $\mu$m.

In the belt transfer type image transfer device in which toner is transferred from the drum 1 to the belt 6, a voltage for image transfer is applied indirectly to the nip or contact portion between the drum 1 and the belt 6. Specifically, a portion of the belt 6 between an inlet roller 12 and an outlet roller or charge applying member 13 is held in contact with the drum 1. The belt 6 has a medium resistance and implemented as a single layer of fluorine resin in which carbon black is dispersed. The belt 6 has a thickness dp of 50 $\mu$m to 300 $\mu$m and a specific inductive capacity $\epsilon p$ of about 11. For the belt 2, use may be made of any other suitable resin, e.g., polycarbonate.

The belt 6 should preferably have a surface resistivity Rs of $1\times10^{7}$ $\Omega/cm^2$ to $1\times10^{10}$ $\Omega/cm^2$ and a volume resistivity Rv of $1\times10^{7}$ $\Omega$cm to $1\times10^{11}$ $\Omega$cm. The surface resistivity and volume resistivity were measured by Hirester IP (MCP-HT260) (trade name) available from Yuka Denshi. For the measurement, use was made of an HRS probe while a bias of 100 V was applied for 10 seconds. The resistivities Rs and Rv may alternatively be measured by a method prescribed by JIS (Japanese Industrial Standards) K6911.

The inlet roller 8 is connected to ground while the outlet roller 13 is applied with a positive transfer voltage Vt. The transfer voltage Vt is output from a power source, not shown, and control led by a control section not shown.

A PCC 10 controls the charge of the toner left on the drum 1 after the belt transfer. Then, a drum cleaning device removes the toner from the drum 1 with a brush and a blade 9. Further, discharger dissipates the charge left on the drum 1. After the transfer of a toner image of a first color to the belt 6, a toner image of a second color is formed on the drum 1 and then transferred to the belt 6 over the toner image of the first color. The transfer voltage may be increased every time one toner image is transferred to the belt 6, if desired. As for a full color image, a black, a cyan, a magenta and a yellow toner image are sequentially transferred to the belt 6 one above the other, and the resulting full color image is transferred to a paper 15 at a time.

To transfer the full color toner from the belt 6 to the paper 14 (paper transfer), a positive voltage is applied from a paper transfer roller 11 to the rear of the paper 15. The toner left on the belt 6 after the paper transfer is removed by a belt cleaning device 18.

While the intermediate transfer body may be implemented as a rigid drum, the belt 2 promotes free layout therearound and therefore the miniaturization of the apparatus more than a drum.

Figure 8:
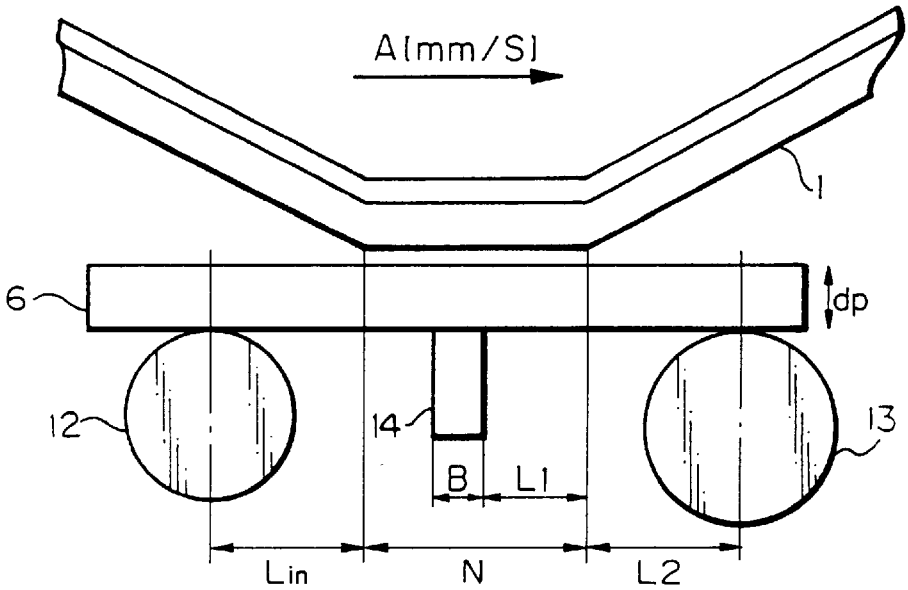
FIG. 8 shows a transfer nip included in the alternative embodiment.

FIG. 8 shows a transfer nip included in the belt transfer type image transfer device. As shown, a discharging member for dissipating a transfer charge is implemented as a conductive brush 14 held in contact with at least a part of the rear of the belt 6 within the nip having a width N. The brush 14 has a width B. The electrode is connected to ground or applied with a voltage opposite in polarity to the transfer bias in order to weaken an electric field for transfer at the inlet side of the nip N. This successfully prevents the toner from flying about due to pretransfer. Assume that the distance between the downstream end of the brush 16 to the end of the nip where separation begins is L1 (mm), and that the distance between the end of the nip and the roller 13 where a charge is applied is L2 (mm).

Figure 9:
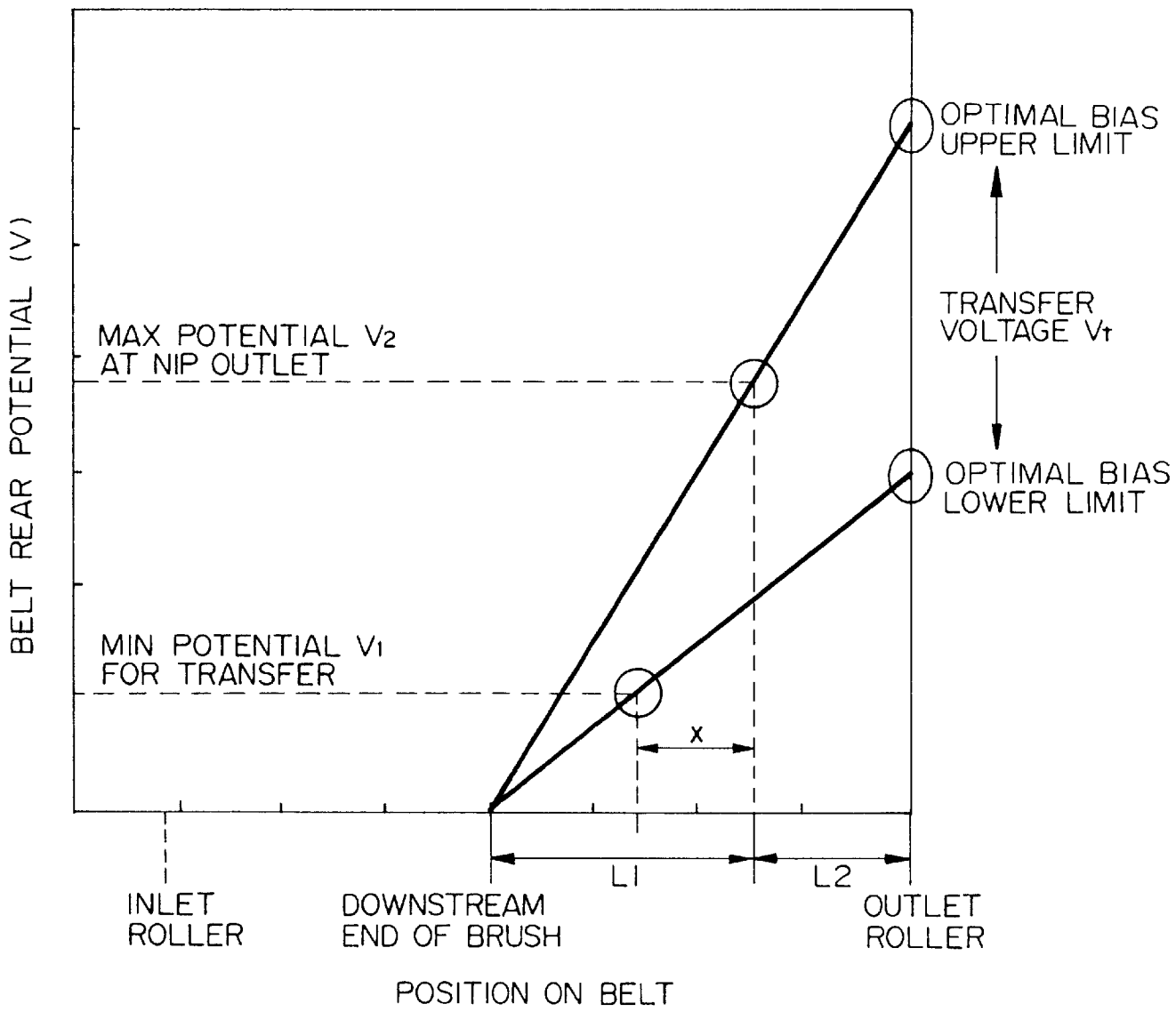
FIG. 9 shows a relation between a position on an intermediate transfer belt adjoining the transfer nip and a potential to deposit on the rear of the belt.

FIG. 9 shows how the potential on the rear of the belt 6 varies at the nip. As shown, so long as the resistance of the belt 6 is relatively low, the potential on the rear of the belt 6 can be approximated by a straight line with respect to the belt position as measured from the above discharging position. The potential on the rear of the belt is zero or positive at the contact portion of the brush 16 or is equal to the transfer bias Vt at the outlet roller 13. Generally, the transfer bias Vt has an optimal range. As the transfer bias Vt increases, the toner transfer efficiency increases; when Vt is equal to Vmin, the transfer efficiency reaches a preselected value, e.g., 90%. When the transfer bias Vt is further increased to Vmax, the transfer efficiency falls below the above preselected value, causing the scattering of toner and other troubles to occur.

Presumably, the lower limit Vmin (V) of the optimal transfer bias range is determined by the minimum potential V1 (V) required to deposit on the rear of the belt 6 in the nip and the minimum period of time $\Delta T$ (second) necessary for the movement of the toner layer. The potential V1 is the minimum potential on the rear of the belt 6 necessary for the toner deposited on the drum 1 to electrostatically move toward the belt 6. The period of time $\Delta T$ is the minimum duration necessary for the potential on the rear of the belt to be maintained higher than V1 (absolute value) in the nip, so that a solid toner image can be transferred from the drum 1 to the belt 6 with a transfer efficiency of 90% or above.

Assume that the drum 1 and belt 2 move at a velocity of A (mm/s). Then, the minimum nip distance X (mm) necessary for the transfer of the toner layer is $A\times\Delta T$. That is, the transfer bias Vt allowing a range in which the potential on the rear of the belt 6 is above V1 (V) to extend over X (mm)

is the minimum value Vmin. The value V1 depends on the potential of the image area of the drum 1 and the amount of charge deposited on the toner. In addition, the value X depends on, e.g., the amount of charge deposited on the toner. However, the values V1 and X can be experimentally determined by varying the combination of the nip width and transfer bias. With FIG. 9, it is possible to produce the following equation representative of Vmin:

$$|\mathrm{Vmin}|=|\mathrm{V0}+(V_1-V_0)\cdot(L1+L2)/(L1-\mathrm{A}\ \Delta\mathrm{T})| \tag{12}$$

where V0 denotes a potential measured at the contact portion of the brush 16.

The upper limit Vmax (V) of the optimal transfer bias range is presumably determined by discharge to occur in the vicinity of the outlet of the nip. Assume that the potential deposited on the rear of the belt 6 and causing Paschen discharge to occur in the vicinity of the outlet of the nip is V2 (V). Then, FIG. 9 gives the following equation representative of Vmax:

$$|\mathrm{Vmax}|=|V0+(V2-V0)\cdot(L1+L2)/L1| \tag{13}$$

The value V2 varies in accordance with the potential of the image area of the drum 1 and the film thickness and dielectric constant of the drum 1. By measuring a transfer efficiency in relation to the transfer bias, it is possible to experimentally determine the values Vmin and Vmax. Further, the values V1 and V2 can also be determined by use of the above equation. By using V1, V2 and ΔT determined beforehand, the values L1 and L2 are so set as to satisfy:

$$|V0+(V_1-V0)\cdot(L1+L2)/(L1-A\cdot\Delta T)|\leqq|Vt|<|V0+(V2-V0)\cdot(L1+L2)/L1| \tag{14}$$

Figure 10A:
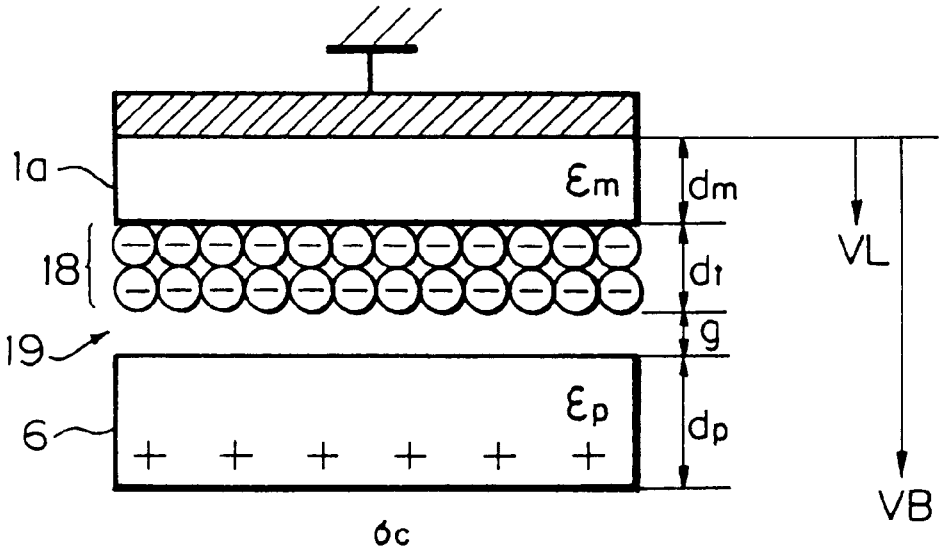
FIG. 10A shows a model representative of the condition of the transfer nip occurring during image transfer.

Assume a transfer model shown in FIG. 10A. As shown, the drum 1 has a photoconductive body or dielectric layer 1*a* having a thickness dm. A dt thick charged toner layer 18 having a volume charge density ρ is present on the photoconductive body 1*a*. The toner layer 18 is transferred from the photoconductive body 1*a* to the belt 6 which is dp thick. The toner layer 18 and transfer body are spaced by a gap 19(g). A charge cc opposite in polarity to the charge of the toner is applied to the belt 6. In this condition, an electrostatic force Fe(x) acting on toner spaced from the surface of the body 1*a* by a distance x and causing it to move toward the belt 6, i.e., a paper is produced by:

$$Fe(x)=q\cdot\frac{-\sigma c-\rho(dt-x)}{\varepsilon_0\varepsilon\gamma l} \tag{15}$$

where εo and εγl respectively denote the dielectric constant of vacuum and the specific inductive capacity of the toner layer.

The toner layer will be entirely transferred only if a force urging the toner on the surface of the photoconductive body 1*a* toward the belt 6 exceeds a mechanical adhering force Fa. The amount of charge σc deposited on the belt 6 is represented by the sum of the strength E of an electric field between the toner layer and the transfer body and the specific inductive capacity of vacuum εo. When the electric field in the gap is represented by a potential VH on the rear of the belt 6 and the surface potential VL of the body 1*a*, the charge σc of the belt 2 may be expressed as:

$$\sigma c=\varepsilon_0\times E=\frac{\varepsilon_0(VH-VL)}{\frac{dp}{\varepsilon p}+\frac{dt}{\varepsilon\gamma l}+\frac{dm}{\varepsilon m}+g} \tag{16}$$

Further, the volume charge density of the toner layer 18 is represented by the toner specific charge q/m:

$$\rho=\delta\cdot P\cdot(q/m) \tag{17}$$

where δ denotes a toner density, and P denotes a packing ratio (ratio of solid portions of toner particles in the volume of the toner layer). By substituting the equation (17) for the equation (15), the following equation representative of Fe is obtained:

$$Fe(x)=\frac{-\sigma c\cdot m(q/m)-\delta pm(dt-x)(q/m)^2}{\varepsilon_0\varepsilon\gamma l} \tag{18}$$

The electrostatic force Fe acting on the toner was calculated with respect to the potential VH on the rear of the belt 6 by using the equations (16) and (18). The results of calculations are plotted in FIGS. 11 and 12. Calculations were effected with the dielectric constant εo=8.85×10$^{-12}$/Nm$^2$ of vacuum, the potential VL=−150 V of the photoconductive body 1*a*, the specific inductive capacity =3.2 of the body 1*a*, the dielectric thickness dp/cp=1 μm of the belt 6 (reduced in consideration of the medium resistance), the toner density ρ=1200 kg/m$^3$, the weight m=0.26 nm (nanogram) of toner for a single particle, the packing ratio P=0.42, the thickness dt=20 μm of the toner layer, the specific inductive capacity εγl=1.6 of the toner layer, and the gap g=0.5 μm. As for the electrostatic force Fe, a force acting on the toner spaced from the surface of the body 1*a* by 3 μm (x=3 μm) was calculated.

Figure 11:
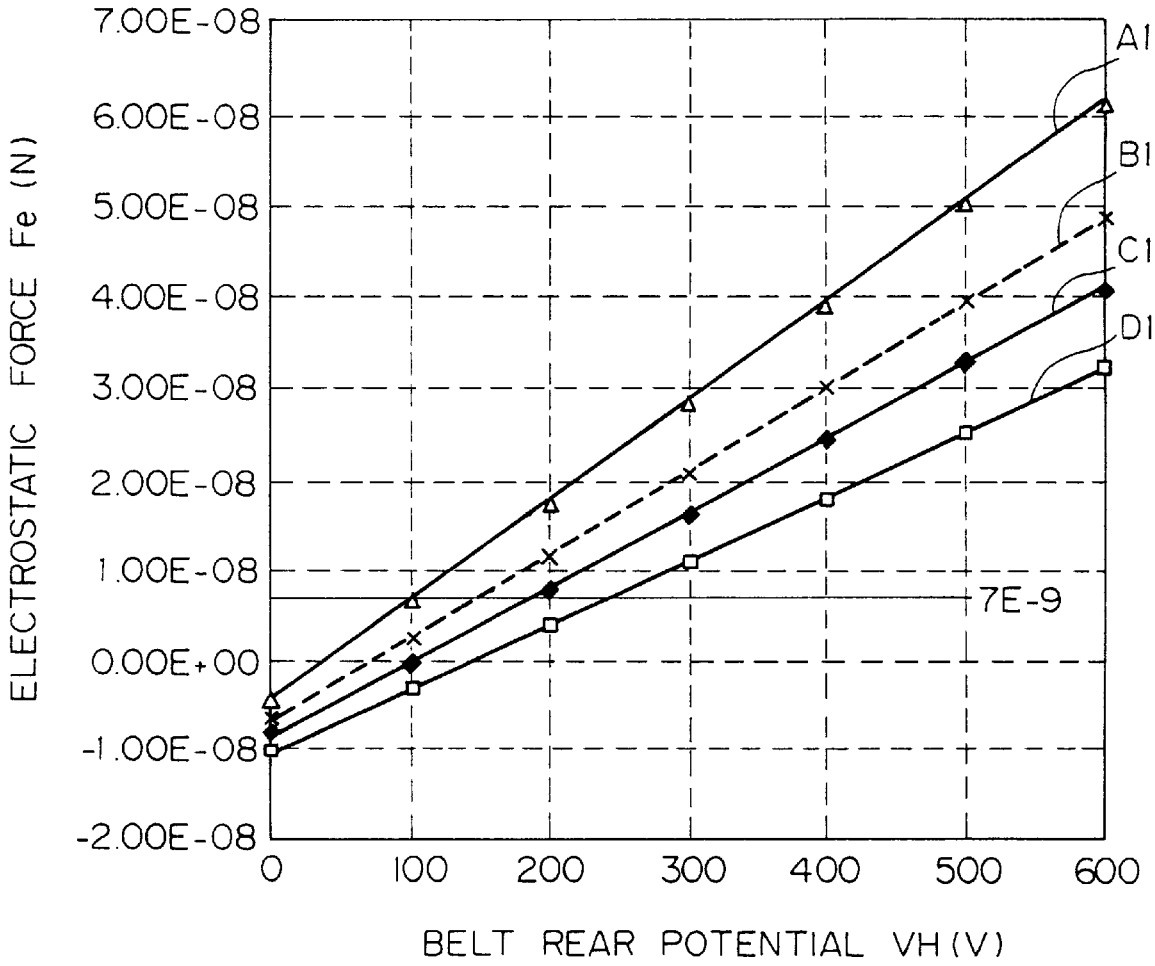
FIGS. 11 and 12 each shows a particular relation between a potential to deposit on the rear of the belt at the transfer nip and an electrostatic force to act on toner.

FIG. 11 shows the results of calculations effected with a mean amount of charge q=−3 fC for a single toner particle, and thicknesses dm=10 μm (Al), 20 μm (B1), 28 μm (C1) and 40 μm (D1) of the photoconductive body 1*a*.

Figure 12:
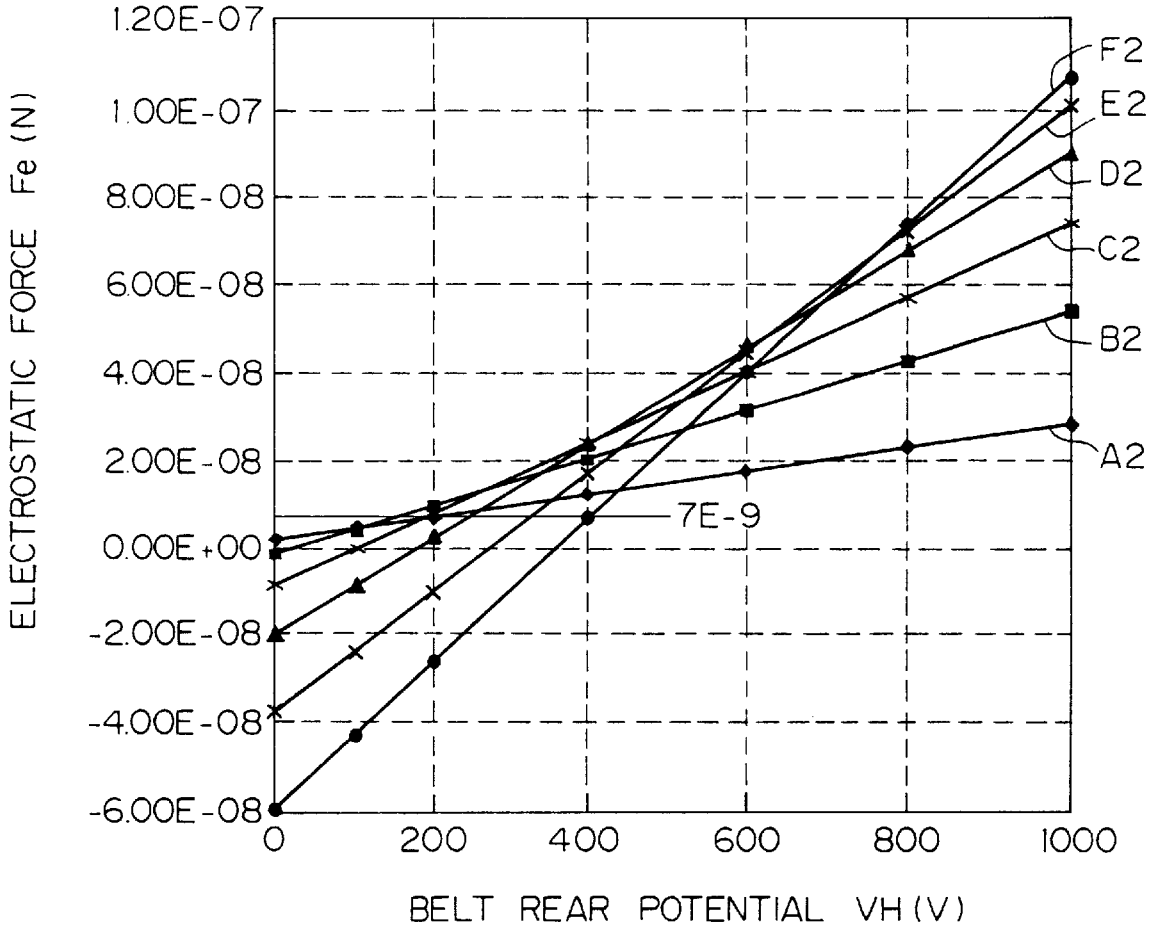

FIG. 12 shows the results of calculations effected with a thickness dm=28 μm of the photoconductive body 1*a* and mean amounts of charge q=−1 fC, −2 fC, −3 fC, −4 fC, −5 fC and −6 fC for a single toner particle. Assuming that the toner has a mean particle size (diameter) of 6 μm, then a value q/d produced by dividing the mean amount of charge by the mean particle size lies in the range of from −0.17 fC/μm to −1 fC/μm.

It is generally known that an adhering force acting between charged toner particles and a photoconductive body is several ten nanonewtons (nN) to several hundred nanonewtons. In the case of the transfer of a toner layer, the effect of a physical force derived from pressure transfer is available. Presumably, therefore, a sufficient transfer efficiency is sometimes achievable even when the electrostatic force generated by an electric field is less than several ten nanonewtons. Experimental results indicated that sufficient transfer occurred when an electrostatic force Fe above 7 nN acts at a position 3 μm spaced from the surface of a photoconductive body (center of toner having a diameter of 6 μm).

The potential V1 on the rear of the belt necessary for implementing a sufficient transfer efficiency, i.e., the force Fe above 7 nN in the range of thickness dm of from 10 μw to 40 μm is, as FIG. 11 indicates, expressed as:

$$|V1|>|\{(100+5\cdot(dm-10)\}+(\mathrm{VL}+150)| \tag{19}$$

In FIG. 11, lines A1, B1, C1 and D1 are respectively representative of data derived from the thicknesses dm of 10 μm, 20 μm, 28 μm and 40 μm. It will be seen from FIG. 11 that the potential Vx on the rear of the transfer body implementing the above electrostatic force Fe of 7 nN is represented by 100+5 (dm−10). Therefore, if the relation (19) taking account of the potential VL of the image area of the image carrier is satisfied, then the toner particles on the image carrier can surely move toward the transfer body.

Further, as FIG. 12 indicates, the potential V1 necessary for implementing a sufficient transfer efficiency, i.e., the force Fe above 7 nN in the range of mean amount of toner charge q of from −2 fC to −6 fC is produced by:

$$|V1| \geqq |140+45(q-2)+5\cdot(q-2)^2+(VL+150)| \quad (20)$$

In FIG. 12, lines A2, B2, C2, D2, E2 and F2 are respectively representative of data derived from the mean amounts of toner charge q of 1 fC, 2 fC, 3 fC, 4 fC, 5 fC and 6 fC. It will be seen from FIG. 12 that the potential Vx implementing the above electrostatic force Fe of 7 nN is represented by $140+45\cdot(q-2)+5\cdot(q-2)^2$ in the range of q of from 2 fC to 6 fC. Therefore, if the relation (20) taking account of the potential VL of the image area of the image carrier is satisfied, then the toner particles on the image carrier can surely move toward the transfer body.

Should the thickness dm of the photoconductive body be less than 10 μm, then the photoconductive body would be critically shaved off due to repeated operation. Further, when the mean amount of toner charge q is −2 fC, the amount of charge for a unit weight of toner is about −8 μC/g; charges q less than −2 fC would cause toner to fly about.

Figure 10B:
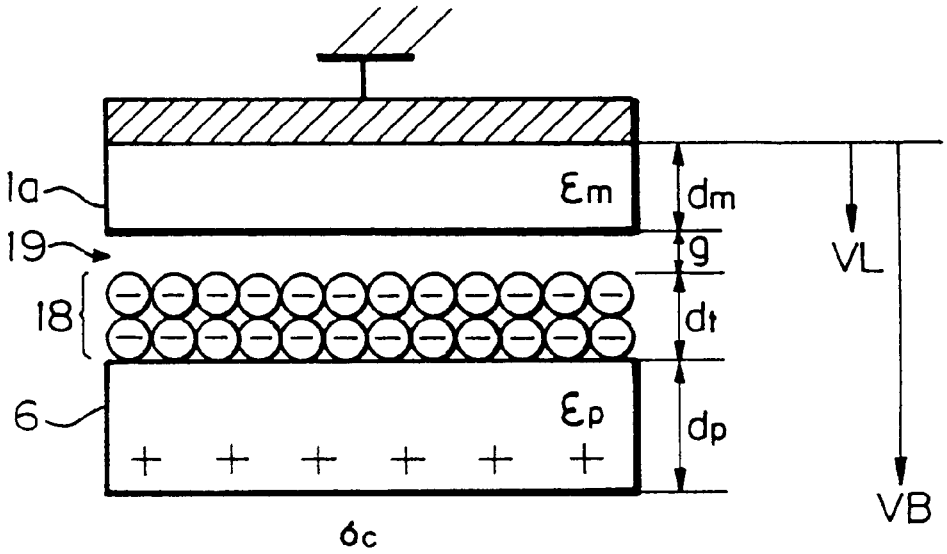
FIG. 10B shows a model representative of the condition of the transfer nip occurring at the end of image transfer.

How discharge occurs at the outlet side of the nip will be described hereinafter. Because the toner layer 18 has moved to the belt 2 at the outlet side of the nip, assume a model shown in FIG. 10B in which the toner layer 18 and the surface of the drum 1 are spaced by a gap. Because the model of FIG. 10B is also a fundamental parallel capacitor model, the electric field in the gap and the charge density are the same as in the equation (16).

Figure 13:
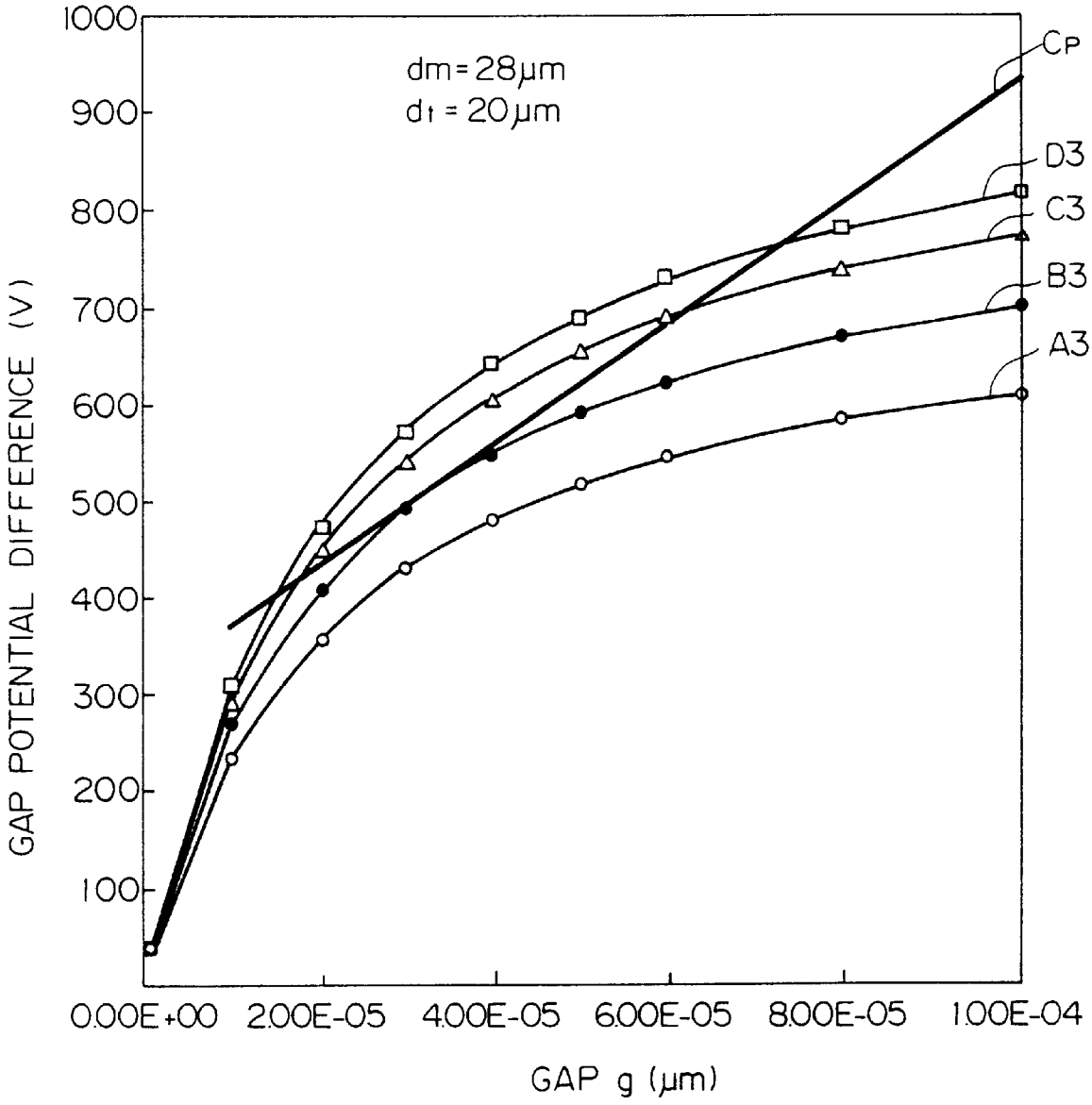
FIG. 13 shows a relation between the size of a gap at the outlet of the transfer nip and a gap potential difference.

FIG. 13 shows the results of calculations showing a relation between the sizes of the gap g (pm) and the potential differences (V) in the gap derived from the potentials VH on the rear of the belt of 600 V (A3), 710 V (B3), 800 V (C3) and 850 V (D3). For the calculations, the thickness dm of the photoconductive body and the thickness dt of the toner layer were selected to be 28 μm and 20 μm, respectively. Also shown in FIG. 13 is a line Cp representative of a discharge limit based on the Paschen's law VP−312+6.2×106×g. It will be seen, based on whether or not the curve intersects the line Cp, discharge occurs when the potential on the rear of the belt is higher than 710 V inclusive and when the gap g is less than about 30 μm inclusive. Assume that the potential on the rear of the belt causing discharge to begin to occur is V2. Then, because the potential VL of the photoconductive body is −150 V, a potential difference between the photoconductive body and the rear of the belt, i.e., V2−VL is 860 V.

Figure 14:
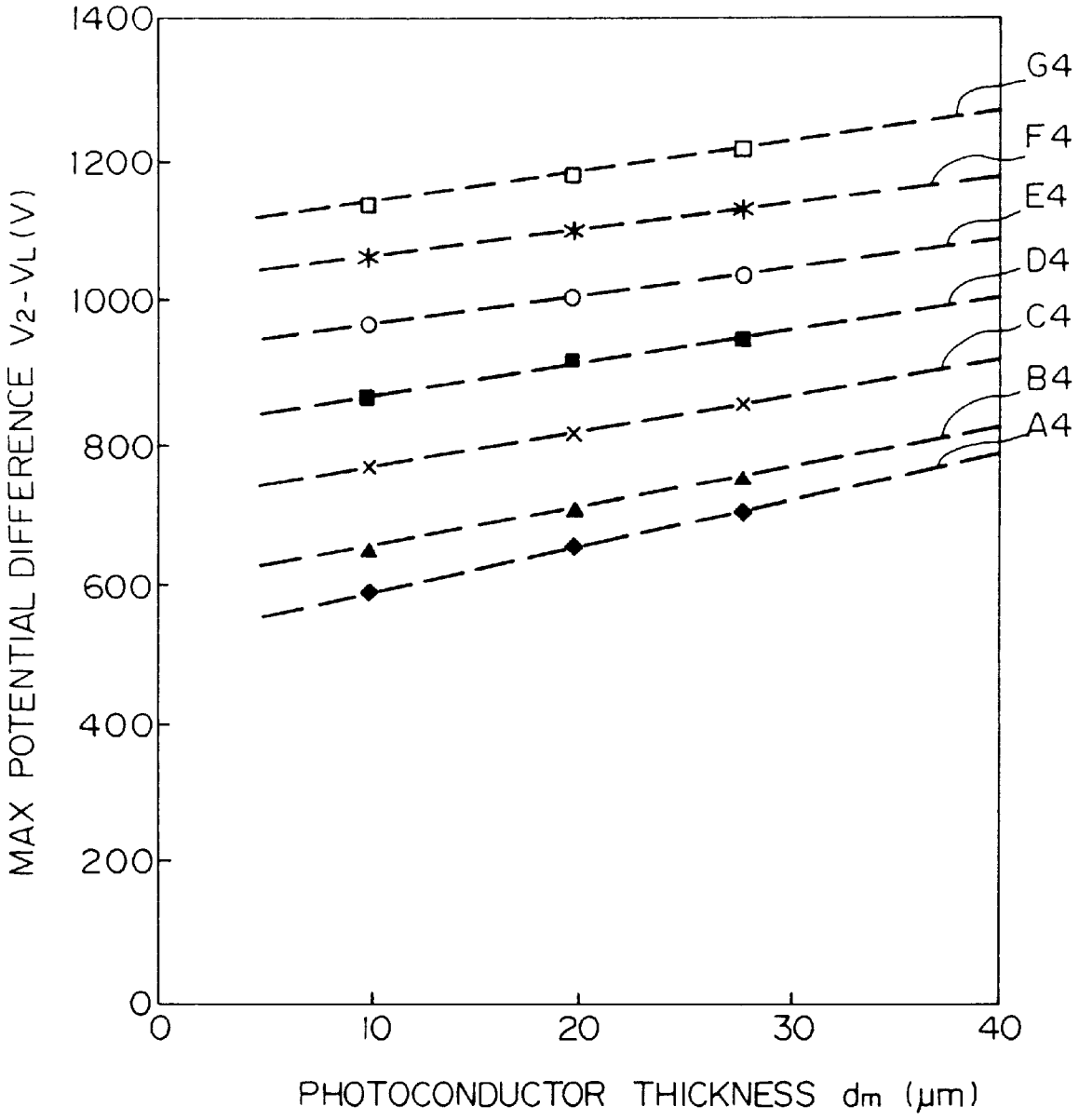
FIG. 14 shows a relation between the thickness of a photoconductive film and the maximum potential difference at the transfer nip.

FIG. 14 shows the results of calculations showing a relation between the thicknesses dm of the photoconductive body and the maximum potential differences V2−VL (V) derived from the toner layer thicknesses dt of 5 μm (A4), 10 μm (B4), 20 μm (C4), 30 μm (D4), 40 μm (E4), 50 μm (F4) and 60 μm (G4). In practice, the toner layer thickness dt on the belt 6 is less than 60 μm inclusive while the thickness dt of the photoconductive body is between 10 μm and 40 μm. Therefore, the maximum potential difference V2−VL that can be selected in such a range is 600 V to 1,300 V. Considering development and transfer for enhancing the sharpness of toner images, the toner layer thickness dt on the belt 6 should preferably be less than 50 μm inclusive while the thickness dt of the photoconductive body should bet between 10 μm and 30 μm. In this preferable range, the maximum potential difference V2−VL is 600 V to 1,200 V.

FIG. 14 indicates that the values V2−VL under the various conditions are expressed as:

$$V2-V_L=\{600+10\cdot(dt-5)\}+5\cdot(dm-10) \quad (21)$$

Therefore, Paschen discharge apt to occur between the image carrier and the transfer body at the end of the contact portion in the direction of movement of the transfer body can be more surely obviated if the following relation is satisfied:

$$|V2|<[\{600+10\cdot(dt-5)\}+5\cdot(dm-10)]+VL \quad (22)$$

In FIG. 14, lines A4, B4, C4, D4, E4, F4 and G4 are respectively representative of data derived from the toner layer thicknesses dt of 5 μm, 10 μm, 20 μm, 30 μm, 40 μm, 50 μm and 60 μm. {600 +10 (dt−5)}+5·(dm−10) representative of V2−VL can be produced from FIG. 14. It follows that if the above relation (22) is satisfied, then Paschen discharge between the image carrier and the transfer body at the above position is obviated.

The distance L1 between the downstream end of the brush 16 and the downstream end of the nip will be discussed hereinafter. To realize a sufficient transfer efficiency, an electrostatic force exceeding a certain preselected value should act for more than a certain preselected period of time ΔT, as stated earlier. Extended studies proved that in the illustrative embodiment the period of time ΔT is 20 ms.

Figure 15:
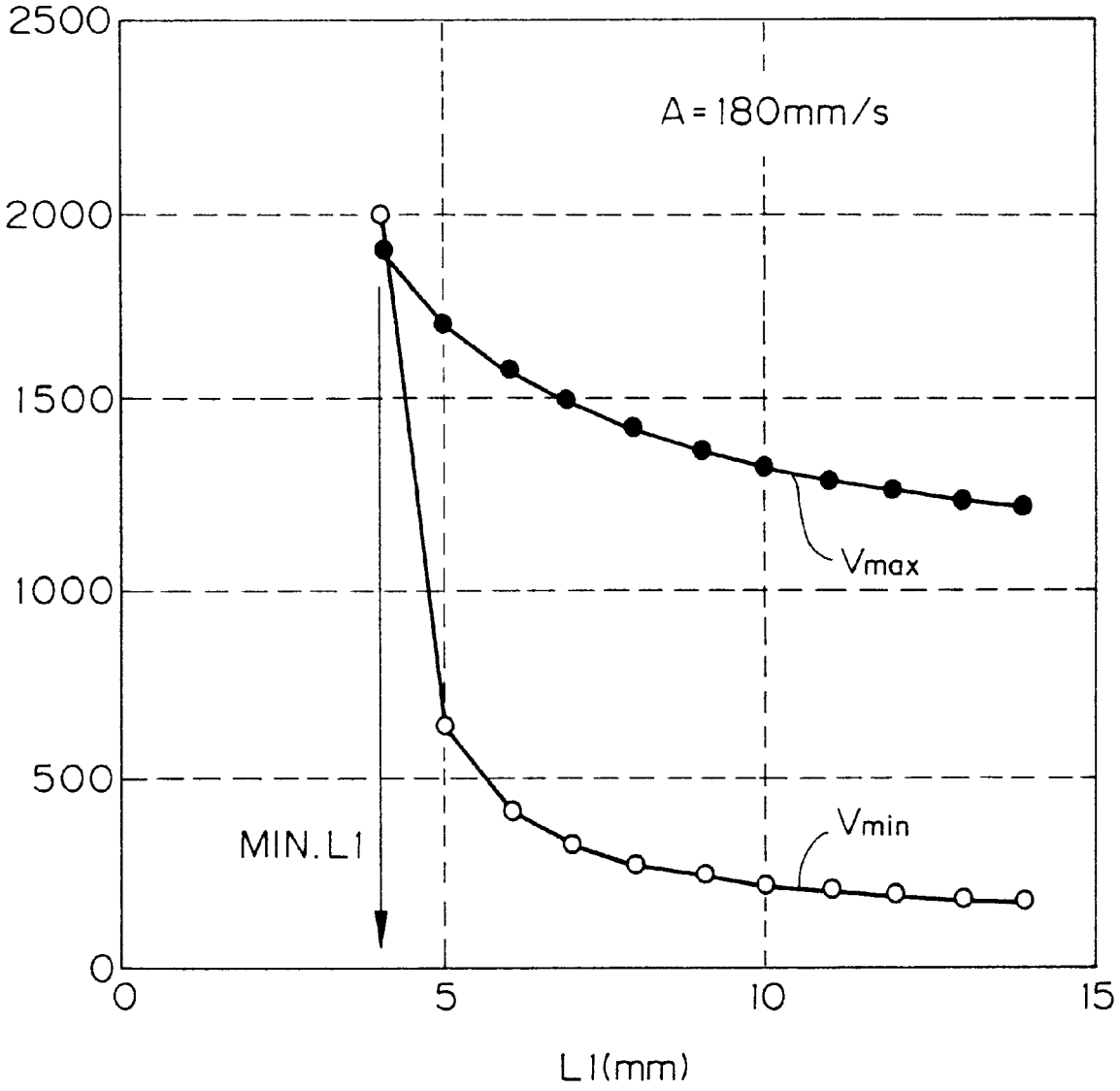
FIG. 15 shows a relation between a distance between the downstream end of a conductive brush and the end of the transfer nip and the optimal range of transfer bias.

FIG. 15 shows the upper limits Vmax and lower limits Vmin of the transfer bias calculated with the equations (12) and (13) on the assumption that ΔT is 0.02 s, A is 180 mm/s, L is 4 mm, V1 is 100 V, and V2 is 950 V. While a range in which Vmax and Vmin reverse themselves exists in the calculation aspect, such a range means that no optimal transfer conditions are available. Therefore, L1 should satisfy a relation of Vmax≧Vmin. In the specific condition shown in FIG. 15, L1 must be greater than 4 mm. This was also true when the value L2 was varied.

Figure 16:
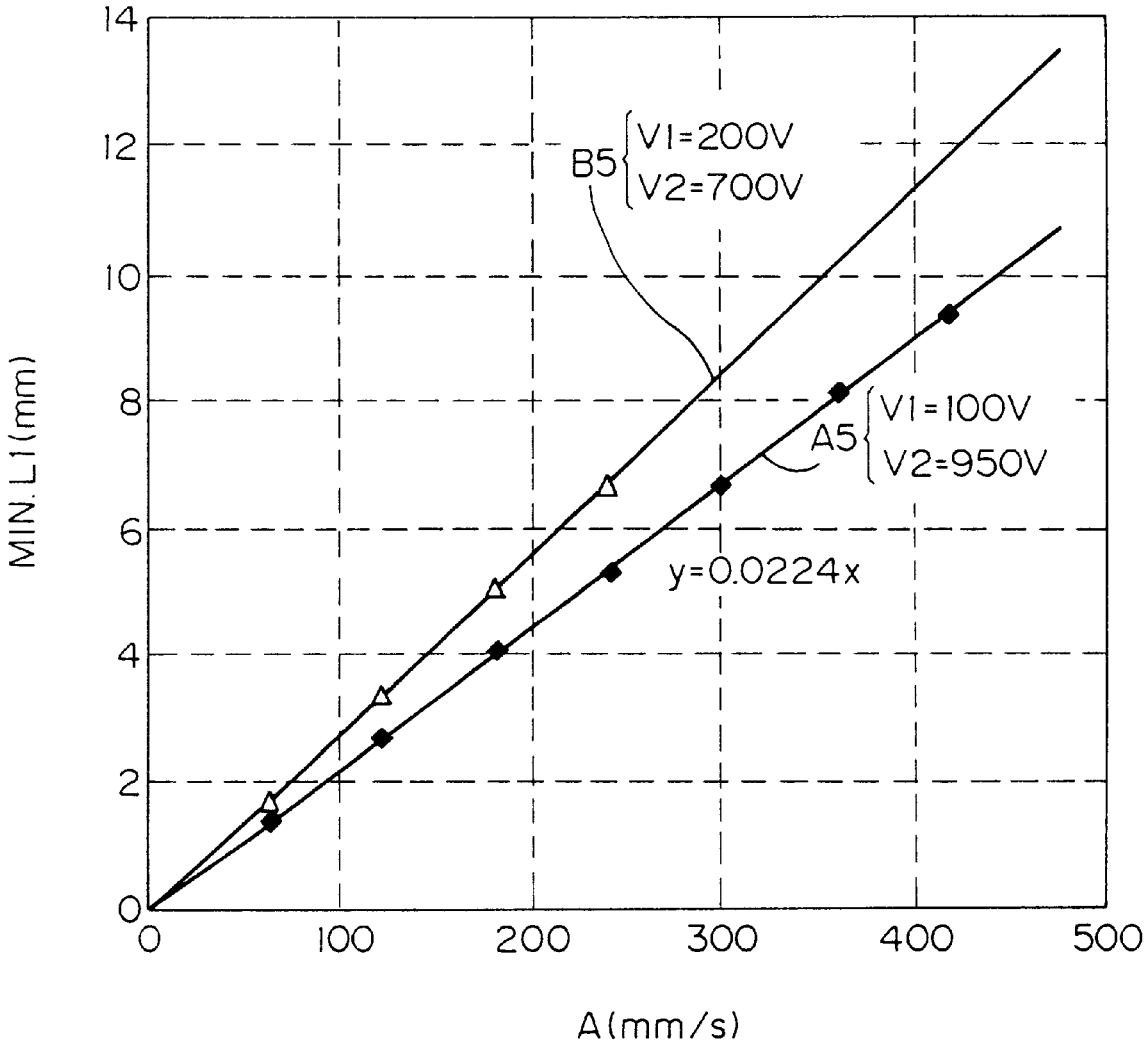
FIG. 16 shows a relation between the linear velocity of the intermediate transfer belt and the minimum distance between the downstream end of the conductive brush and the end of the transfer nip.

FIG. 16, like FIG. 15, shows the lower limits of L1 (minimum L1) calculated by varying the moving speed A mm/s of the belt 6. Specifically, there are shown in FIG. 16 a case (A5) wherein V1 and V2 were 100 V and 950 V, respectively, and a case (B5) wherein V1 and V2 were 200 V and 700 V, respectively. As FIG. 16 indicates, the lower limit of L1 increases in proportion to the moving speed A. It will also be seen from FIG. 16 that to realize a preselected transfer efficiency and to obviate discharge at the downstream end of the nip, L1 greater than 0.022×A inclusive must be selected under the conditions of V1=100 V and V2=950 V, as follows:

$$L1>0.022\times A \quad (23)$$

There can be produced from FIG. 16 0.022×A representative of the minimum value of L1 when V1 and V2 are 100 V and 950 V, respectively. It follows that if the above relation (23) is satisfied, a solid toner image can be transferred from the image carrier to the transfer body in the contact portion by a transfer efficiency as high as 90% or above. In addition, Paschen discharge does not occur between the image carrier and the transfer body at the end of the contact portion.

Also, under the conditions of V1=200 V and V2=700 V, there must be satisfied a relation:

$$L1 \geqq 0.029 \times A \quad (24)$$

As for the resistance of the belt 2, the illustrative embodiment selects a surface resistivity Rs of $1\times10^7$ Q/cm$^2$ to $1\times10^{10}$ Ω/cm$^2$ or a volume resistivity Rv of $1\times10^7$ Ωcm to $1\times10^{11}$ Ωcm. Should the resistance be lower than the above range, the transfer bias would leak and prevent a satisfactory transfer efficiency from being achieved. Should the resistance be higher than the above range, the potential on the rear of the belt 6 could not be approximated by a straight line as shown in FIG. 9, preventing the equations and relation (12)–(14) from holding.

As for the amount of charge to deposit on the toner, assume that the mean amount of charge q for a single toner particle varies in the range of from −1 fC to −6 fC, as shown in FIG. 12. Then, the amount of charge q/d for a unit mean particle size is −0.17 fC/μm to −1 fC/μm. Should the amount of charge be smaller than the above range, the toner would fly about. Should the amount of charge be greater than the same range, there would easily occur the deterioration of transferability and defective images. In addition, an increase in the amount of charge would narrow the range of optimal transfer bias.

Figure 17:
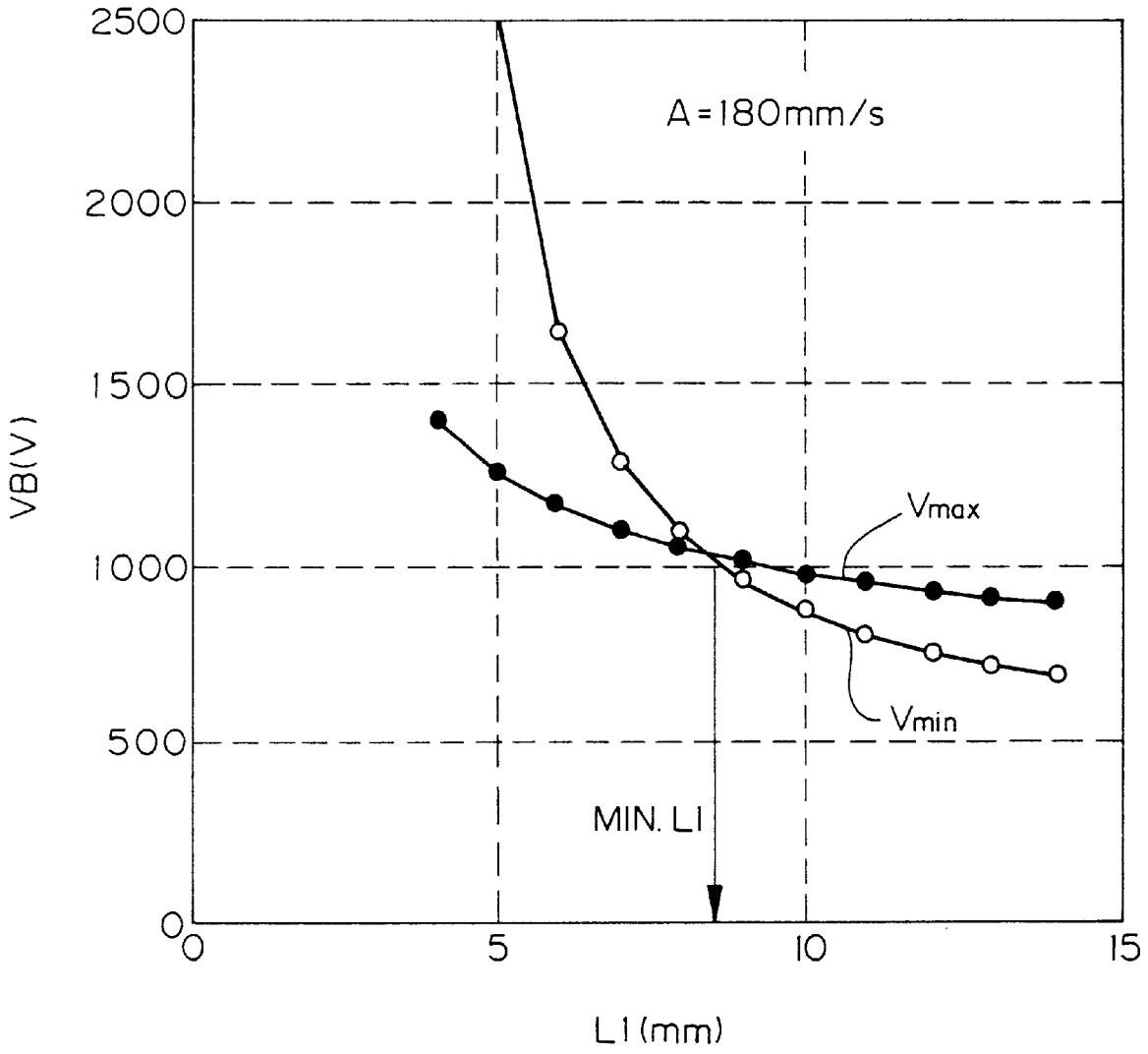
FIG. 17 shows a relation between the distance between the downstream end of the conductive brush and the end of the transfer nip and the optimal range of transfer bias.

FIG. 17 shows the results of calculations similar to the results shown in FIG. 15 and derived from a mean amount of charge q of −6 fC for a single toner particle. As shown, the minimum L1 value increases from 4 mm to about 8.5 mm, reflecting the variation of the electrostatic force Fe shown in FIG. 12.

As stated above, the illustrative embodiment selects L1 and L2 each having a particular value. This successfully transfers a solid toner image from the drum 1 to the belt 6 with an efficiency as high as 90% or above, and obviates Paschen discharge between the image area of the drum 1 and the belt 6 at the end of the nip in the direction of movement of the belt 6.

The illustrative embodiment may additionally include control means for controlling the transfer bias to be applied to the outlet roller 13. Considering the variation of the transfer efficiency due to the varying environmental conditions and the resistance of the belt 6, it is preferable to set a transfer bias condition by condition within the previously stated optimal range. For example, the control means may control the transfer bias in accordance with the output of a temperature/humidity sensor. Alternatively, the variation of the resistance of the belt 6 due to aging may be estimated by experience and used to control the transfer bias in accordance with the history of operation.

Specific examples and specific comparative examples of the above embodiment will be described hereinafter.

EXAMPLE 1

Figure 7:
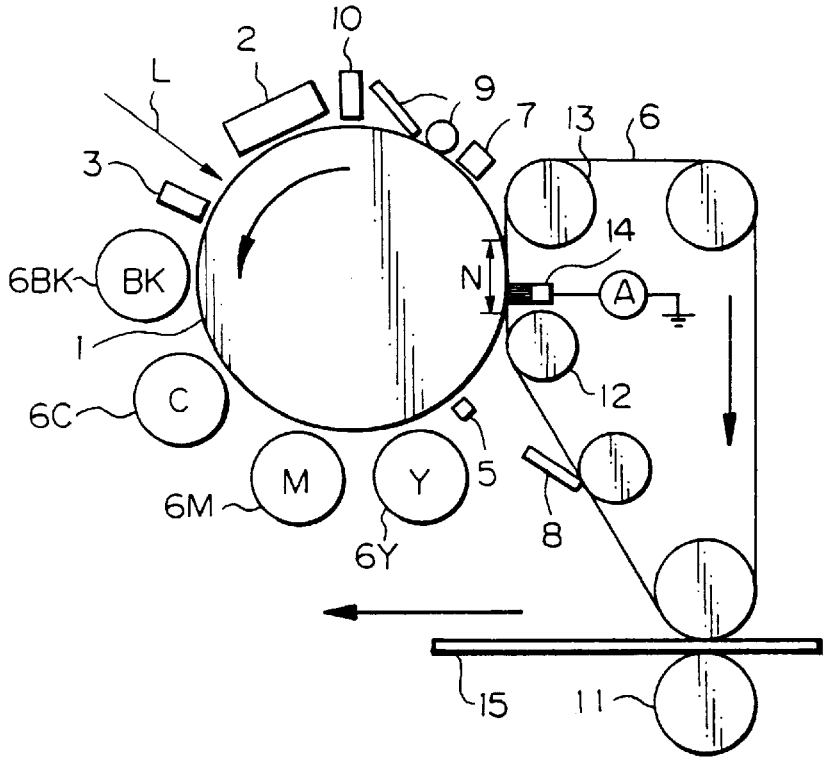
FIG. 7 shows an alternative embodiment of the present invention implemented as a color image forming apparatus.

In the construction shown in FIG. 7, the drum 1 had a 28 μm thick photoconductive layer or film. The belt 2 was 150 μm thick and had a volume resistivity Rv of about $1\times10^{10}$ Ωcm. The belt 6 was moved at a velocity of 180 mm/s. The distance LI between the downstream end of the brush 14 in the nip and the downstream end of the nip was 10 mm. The distance L2 between the downstream end of the nip and the contact position of the outlet roller 13 was 8 mm. Under these conditions, the relation (23) is satisfied. The brush 16 was implemented by a conductive brush formed of acrylic fibers with carbon black dispersed therein. The brush 14 is capable of evenly contacting the rear of the belt 6 and reducing the required contact pressure.

When the charge potential of the drum 1 was −650 V, when the bias for development was −500 V, when the potential of the exposed portion was −150 V, and when the charge deposited on the toner was about −15 μC/g, an amount of toner development of about 1.5 mg/cm$^2$ was achieved which implemented sufficient image density in a monocolor mode. The toner layer had a thickness of about 20 m on the average, as measured by non-contact surface configuration measuring device (VF7500 available from Keyence). The toner particles had a density of 1.2 g/cm$^3$ while the toner layer had a packing density P of 0.42. The charge distribution of the toner particles was about −3 fC on the average, as measured by E Spart Analyzer mentioned earlier. The minimum potential V1 required to deposit on the rear of the belt 6 for the transfer of a toner image in the nip was measured to be about 200 V. This satisfies the relations (19) and (20). The region in which the potential on the rear of the belt 6 was higher than 200 V inclusive was required to extend over more than 4 mm inclusive. This satisfies the relation (23). Further, when the potential V2 on the rear of the belt 6 measured at the downstream end of the nip was higher than about 700 V inclusive, the amount of charge deposited on toner was found to vary to the negative side after image transfer, indicating the occurrence of discharge at the outlet of the nip. This coincides with a result not satisfying the relation (22). Under these conditions, the relation (14) is $600 \leqq Vt \leqq 1260$. Actual estimation of the transfer of solid images to the belt 2 showed that when the transfer bias was about 700 V to about 1,200 V, the transfer efficiency increased to 90% or above and desirable images free from the scattering of toner were output. Particularly, toner was scattered little when the transfer bias was 800 V.

EXAMPLE 2

Example 1 was repeated except for the discharging member was implemented by a conductive rubber roller. In this example, while the rubber roller deforms and evenly contacts the rear of the belt 6, it exerts a relatively high pressure. The estimation of the transfer of solid images to the belt 6 showed that when the transfer bias was about 700 V to about 1,200 V, the transfer efficiency increased to 90% or above and desirable images free from the scattering of toner were output. Again, toner was scattered little when the transfer bias was 800 V. However, toner was slightly lost in text images. This is presumably because the hardness of the rubber roller was not optimized and caused the roller to exert an excessive pressure on the toner layer in the nip.

COMPARATIVE EXAMPLE 1

When the transfer bias selected in Example 1 was controlled to 500 V not satisfying the relation (14), the transfer efficiency of a solid image was as low as about 70%. When the transfer bias was 1,400 V, reverse transfer ascribable to discharge occurred at the outlet of the nip and lowered the transfer efficiency.

COMPARATIVE EXAMPLE 2

Example 1 was repeated except for the charge potential of −30 V, development bias of −380 V and potential VL of −30 V. Because the amount of toner for development was the same as in Example 1, the transfer bias of 800 V was also applied. The estimation of the transfer of a solid image effected under such conditions showed that some defective transfer occurred. The above conditions do not satisfy the relations (19) and (20).

COMPARATIVE EXAMPLE 3

Example 1 was repeated except for two toner layers of different colors and about 30 μm thick each were transferred to the belt 2 one above the other in order to form a bicolor toner image. The toner layer of the first color was desirably transferred to the belt 2 by a transfer bias of about 1,100 V. As for the toner layer of the second color increasing the thickness of toner on the belt 6 to about 60 μm, the best transfer efficiency was achieved when the transfer bias was about 1,500 V; the transfer efficiency was lowered at transfer biases above 1,500 V. Transfer biases above 1,500 V increased the potential on the rear of the belt 6 to about 1,100 V or above at the outlet of the nip, failing to satisfy the relation (22). As a result, discharge presumably occurs at the outlet of the nip and lowers the transfer efficiency. To obviate discharge at the outlet of the nip, the toner layer thickness must be reduced below 50 μm or the thickness of the photoconductive body must be reduced below 20 μm, as FIG. 14 and relation (22) indicate.

COMPARATIVE EXAMPLE 4

Example 1 was repeated except that the distance L1 was selected to be 3 mm. In this condition, a transfer bias implementing a transfer efficiency above 80% could not be achieved. This does not satisfy the relation of $L1 \geqq A \times 0.022$ and presumably failed to implement the transferring force necessary for the movement of the toner.

COMPARATIVE EXAMPLE 5

Example 1 was repeated except that the conductive body was 40 μm thick. In this condition, the sharpness of text images was degraded. This is presumably ascribable to a decrease in the capacity of the photoconductive body and therefore in the charge density of the surface of the drum.

COMPARATIVE EXAMPLE 6

Example 1 was repeated except that the belt 6 in the form of a single layer had a surface resistivity Rs of about $1\times10^{11}$ $\Omega/cm^2$ and a volume resistivity Rv of about $1\times10^{12}$ Ωcm. The optimal transfer bias in the case of a monocolor toner layer was measured to be 1,400 V to 1,800 V and did not satisfy the relations (7) and (8). This is presumably because an increase in the resistance of the belt 6 disturbs the linearity of the potential on the rear of the belt 6 in the direction of movement of the belt 6.

COMPARATIVE EXAMPLE 7

Example 1 was repeated except that the amount of charge to deposit on the toner was increased. Specifically, the kind of carrier particles contained in the developer was changed in order to double the amount of charge Q/M of the developer to about −50 μC/g. Further, the charge potential of the photoconductive body, transfer bias and potential after exposure were respectively selected to be −850 V, −700 V and −150 V, so that the amount of toner for development remained substantially constant. To measure the charge distribution of toner deposited on the drum 1, the conductive body is implemented as a sheet. A part of the sheet-like photoconductive body is cut off and set on a stage included in E Spart Analyzer. When the mean q/d of the toner was −1.2 fC/μm, a transfer bias implementing a transfer efficiency above 90% was not achieved.

While the illustrative embodiment has concentrated on the photoconductive drum 1, the present invention is similarly practicable with any other suitable photoconductive element, e. g., a photoconductive belt.

The present invention is applicable even to the transfer of an image from a photoconductive drum to a conveyor conveying a recording medium or from an intermediate transfer belt to such a conveyor, as distinguished from the transfer from the drum 1 to the belt 6. The transfer body or the conveyor may be implemented as, e.g., a drum or a roller in place of the belt. The intermediate transfer body and conveyor may each have particular electric characteristics (volume resistivity and surface resistivity), a particular thickness and a particular structure (single layer, double layer or the like) matching with desired image forming conditions. This is also true with the material and to be used.

The roller playing the role of a charge applying member may, of course, be replaced with, e.g., a conductive brush (metal or resin) or a conductive blade (metal, resin or rubber). The transfer charge may be applied at a position other than the downstream end of the nip so long as it lies in the nip. Further, the voltages (transfer biases) stated specifically in the illustrative embodiments are only illustrative and may be varied in accordance with image forming conditions.

While the discharging member is implemented as a conductive brush in the illustrative embodiments, the present invention is similarly practicable with a conductive roller (metal or resin), conductive blade (metal, resin or rubber) or similar discharging member. The discharging member may contact the conveyor for conveying a recording medium at any position within the nip. In addition, for the charge applying member for applying a transfer charge to a recording medium, use may be made of a belt, brush, blade or the like in place of a roller shown and described, or even a corona discharger.

In summary, it will be seen that the present invention provides an image forming apparatus having various unprecedented advantages, as enumerated below.

(1) A solid toner image formed on an image carrier can be transferred to a transfer body by a transfer efficiency higher than 90%.

(2) Paschen discharge between the image carrier and the transfer body can be obviated at the end of a portion where the image carrier and transfer body contact each other in the direction of movement of the transfer body. Paschen discharge would deteriorate the image transfer.

(3) Toner particles on the image carrier surely leave the image carrier toward the transfer body, so that a desired transfer efficiency is surely achieved.

(4) Only if a discharging member is connected to ground, there can be obviated pretransfer otherwise occurring at a side upstream of the contact portion in the direction of movement of the transfer body.

(5) Pretransfer can be more positively obviated, compared to the case wherein the discharging member is connected to ground.

(6) Irregular contact between the discharging member and the transfer body is reduced, compared to a case wherein the discharging member is implemented as a rigid member.

(7) The image carrier is highly durable. In addition, there can be reduced a decrease in the charge density on the surface of the image carrier ascribable to a decrease in the capacity of the dielectric layer of the image carrier. This prevents the sharpness of text images from being lowered.

(8) There can be obviated the scattering of toner, the degradation of transferability, and defective images.

(9) The leak of a transfer charge applied to the transfer body is reduced, so that a desired transfer efficiency can be surely achieved. In addition, the relation (14) surely holds.

Various modifications will become possible for those skilled in the art after receiving the teachings of the present disclosure without departing from the scope thereof.

What is claimed is:

1. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity R (Ωcm; $R=10^3-10^{11}$), that a surface potential of said image carrier in an image area is $V_L$, that a voltage to be applied to said transfer electrode is Vt, and that X, is equal to $L_1/L$, then there are satisfied relations:

$$Vb_1=Vt(aX_1^2+bX_1)/800$$

$$a=500+300(\log R-10)$$

$$b=300-300(\log R-10)$$

$$250+V_2\leqq Vb_1.$$

2. An apparatus as claimed in claim 1, wherein assuming $V_1=250+V_L$, then there is satisfied a relation:

$$X_0=[-b\cdot Vt+(b^2\cdot Vt^2+3{,}200\cdot a\cdot Vt\cdot V_1)^{0.5}]/(2\cdot a\cdot Vt)\ (X_1-X_0)\cdot L>4\ \text{(mm)}.$$

3. An apparatus as claimed in claim 1, wherein assuming $V_1=250+V_L$ and assuming a linear velocity Va of said transfer body, then there are satisfied relations:

$$X_0=[-b\cdot Vt+(b^2\cdot Vt^2+3{,}200\cdot a\cdot Vt\cdot V_1)^{0.5}]/(2\cdot a\cdot Vt)$$

$$t_0=(X_1-X_0)\cdot L/Va>0.022\ \text{(sec)}.$$

4. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity R (Ωcm; $R=10^3-10^{11}$), that a surface potential of said image carrier in an image area is $V_L$, that a voltage to be applied to said transfer electrode is Vt, and that $X_1$ is equal to $L_1/L$, then there are satisfied relations:

$$Vb_1=Vt(a\cdot X_1^2+b\cdot X_1)/800$$

$$a=500+300(\log R-10)$$

$$b=300-300(\log R-10)$$

$$1{,}200+V_L\geqq Vb_1.$$

5. An apparatus as claimed in claim 4, wherein assuming $V_1=250+V_L$, then there is satisfied a relation:

$$X_0=[-b\cdot Vt+(b^2\cdot Vt^2+3{,}200\cdot a\cdot Vt\cdot V_1)^{0.5}]/(2\cdot a\cdot Vt)\ (X_1-X_0)\cdot L>4\ \text{(mm)}.$$

6. An apparatus as claimed in claim 4, wherein assuming $V_1=250+V_L$ and a linear velocity Va of said transfer body, then there are satisfied relations:

$$X_0=[-b\cdot Vt+(b^2\cdot Vt^2+3{,}200\cdot a\cdot Vt\cdot V_1)^{0.5}]/(2\cdot a\cdot Vt)$$

$$t_0=(X_1-X_0)\cdot L/Va>0.022\ \text{(sec)}.$$

7. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity R (Ωcm; $R=10^3-10^{11}$), that a surface potential of said image carrier in an image area is $V_L$, that a voltage to be applied to said transfer electrode is Vt, and that $X_1$ is equal to $L_1/L$, then there are satisfied relations:

$$Vb_1=Vt(a\cdot X_1^2+b\cdot X_1)/800$$

$$a=500+300(\log R-10)$$

$$b=300-300(\log R-10)$$

$$700+V_L\geqq Vb_1\geqq 400+V_L.$$

8. An apparatus as claimed in claim 7, wherein assuming $V_1=250+V_L$, then there is satisfied a relation:

$$X_0=[-b\cdot Vt+(b^2\cdot Vt^2+3{,}200\cdot a\cdot Vt\cdot V_1)^{0.5}]/(2\cdot a\cdot Vt)\ (X_1-X_0)\cdot L>4\ \text{(mm)}.$$

9. An apparatus as claimed in claim 7, wherein assuming $V_1=250+V_L$ and a linear velocity Va of said transfer body, then there are satisfied relations:

$$X_0=[-b\cdot Vt+(b^2\cdot Vt^2+3{,}200\cdot a\cdot Vt\cdot V_1)^{0.5}]/(2\cdot a\cdot Vt)$$

$$t_0=(X_1-X_0)\cdot L/Va>0.022 \text{ (sec)}.$$

10. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity R (Ωcm; $R=10^3-10^{11}$), that a surface potential of said image carrier in an image area is $V_L$, that a voltage to be applied to said transfer electrode is Vt, that $X_1$ is equal to $L_1/L$, and that $Vb_1$ is equal to $Vt\cdot X_1$, then there is satisfied a relation:

$$250+V_L<Vt\cdot L_1/L.$$

11. An apparatus as claimed in claim 10, wherein assuming $V_1=250+V_L$, then there is satisfied a relation:

$$(L_1/L-V_1/Vt)\cdot L>4 \text{ (mm)}.$$

12. An apparatus as claimed in claim 10, wherein assuming a linear velocity Va of said transfer body, then there is satisfied a relation:

$$(L_1/L-V_1/Vt)\cdot L/Va>0.022 \text{ (sec)}.$$

13. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity R (Ωcm; $R=10^3-10^{11}$), that a surface potential of said image carrier in an image area is $V_L$, that a voltage to be applied to said transfer electrode is Vt, that $X_1$ is equal to $L_1/L$, and that $Vb_1$ is equal to $Vt\cdot X_1$, then there is satisfied a relation:

$$1200+V_L>Vt\cdot L_1/L.$$

14. An apparatus as claimed in claim 13, wherein assuming $V_1=250+V_L$, then there is satisfied a relation:

$$(L_1/L-V_1/Vt)\cdot L>4 \text{ (mm)}.$$

15. An apparatus as claimed in claim 13, wherein assuming $V_1=250+V_L$ and a linear velocity Va of said transfer body, then there is satisfied a relation:

$$(L_1/L-V_1/Vt)\cdot L/Va>0.022 \text{ (sec)}.$$

16. An image forming apparatus comprising:

an image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a contact portion where said image carrier and said transfer body contact each other; and a transfer electrode positioned downstream of said discharge electrode in a direction of movement of said transfer body for applying a transfer charge to said transfer body;

wherein assuming that a distance between a position where said discharge electrode faces said transfer body and an end of said contact portion is $L_1$ (mm), that a distance between said discharge electrode and a position where said transfer electrode faces said transfer body is L (mm), that a distance measured from said discharge electrode toward said position where said transfer electrode faces said transfer body is d (mm), that said transfer body has a volume resistivity (R (Ωcm; $R=10^3-10^{11}$), that a surface potential of said image carrier in an image area is $V_L$, that a voltage to be applied to said transfer electrode is Vt, that $X_1$ is equal to $L_1/L$, and that $Vb_1$ is equal to $Vt\cdot X_1$, then there is satisfied a relation:

$$700+V_L>Vt\cdot L_1/L\geqq 400+V_L.$$

17. An apparatus as claimed in claim 16, wherein assuming $V_1=250+V_L$, then there is satisfied a relation:

$$(L_1/L-V_1/Vt)\cdot L>4 \text{ (mm)}.$$

18. An apparatus as claimed in claim 16, wherein assuming $V_1=250+V_L$ and a linear velocity Va of said transfer body, then there is satisfied a relation:

$$(L_1/L-V_1/Vt)\cdot L/Va>0.022 \text{ (sec)}.$$

19. An image forming apparatus comprising:

an image carrier for forming a toner image thereon;

a transfer body contacting said image carrier for transferring the toner image from said image carrier to a recording medium via said transfer body;

a discharge electrode for reducing a transfer charge applied to said transfer body at a discharge position lying in a contact portion where said image carrier and said transfer body contact each other; and a transfer electrode positioned downstream of said discharge electrode in a direction of movement of said transfer body for applying a transfer charge to said transfer body;

said discharge position being adjustable in matching relation to aging of said image carrier, said discharge electrode and said transfer body, a varying environment and irregularity in parts to thereby maintain an optimal transfer efficiency.

20. An apparatus as claimed in claim 19, wherein said discharge electrode is displaceable over a range in which said image carrier and said transfer body contact each other.

21. An apparatus as claimed in claim 19, wherein when a defective transfer occurs, said discharge electrode is shifted to an upstream side in a direction of movement of said transfer body.

22. An apparatus as claimed in claim 19, wherein when an excessive transfer occurs, said discharge electrode is shifted to a downstream side in a direction of movement of said transfer body.

23. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then image transfer to said transfer body is effected with the potential of said transfer body being held higher than V1 inclusive for more than said period of time ΔT inclusive from said discharge position to an end of said contact portion.

24. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, image transfer to said transfer body is effected with a potential of said transfer body, as measured at an end of said contact portion, being maintained lower than a voltage generating a potential difference causative of Paschen discharge between said image carrier and said transfer body at said end of said contact portion.

25. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then image transfer to said transfer body is effected with the potential of said transfer body being held higher than V1 inclusive for more than said period of time ΔT inclusive from said discharge position to an end of said contact portion, and with a potential of said transfer body, as measured at said end of said contact portion, being maintained lower than a voltage generating a potential difference causative of Paschen discharge between said image carrier and said transfer body at said end.

26. In an image transfer device including a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then potential of said transfer body is held higher than, in absolute value, said minimum potential V1 inclusive for more than said minimum period of time ΔT inclusive from said discharge position to an end of said contact portion.

27. In an image transfer device including a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion, assuming that a potential of said transfer body generating a potential difference causative of Paschen discharge between said image carrier and said transfer body at an end of said contact portion is V2 (V), then a potential of said transfer body at said end is lower than said potential V2 in absolute value.

28. In an image transfer device including a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), and that a potential of said transfer body generating a potential difference causative of Paschen discharge between said image carrier and said transfer body at said end of said contact portion is V2 (V), then the potential of said transfer body is held higher than, in absolute value, said minimum potential inclusive for more than said minimum period of time ΔT inclusive from said discharge position to said end of said contact portion, and the potential of said transfer body at said end is lower than said potential V2 in absolute value.

29. A device claimed in claim 28, wherein said transfer body comprises a belt having an electric resistance setting up a linear relation between a potential on a rear thereof opposite to a front contacting said image carrier and a distance, as measured on said rear, from said discharge position in the direction of movement of said transfer body, wherein said rear is discharged while the transfer charge is applied to said rear at a position downstream of said end of said contact portion in the direction of movement of said transfer body, and wherein assuming that a distance between said end and a position where the transfer charge is applied is L2 (mm), that said transfer body moves at a speed of A (mm/s), that the potential of a charge applying member is Vt (V), and that a potential of said discharging member is V0 (V), then there is satisfied a relation:

$$|V0+(V1-V0)\cdot(L1+L2)/(L1-A\cdot\Delta T)|\leq|Vt|<|V0+(V2V0)\cdot(L1+L2)/L1|.$$

30. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then image transfer to said transfer body is effected with a potential of said transfer body being held higher than, in absolute value, said minimum potential V1 inclusive from said discharge position to an end of said contact portion.

31. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, image transfer to said transfer body is effected with a potential of said transfer body at an end of said contact portion being held lower than a voltage generating a potential difference causative of Paschen discharge between said image carrier and said transfer body at said end.

32. In a method of transferring a toner image formed on an image carrier to a transfer body movable in contact with, over a preselected distance, a surface of said image carrier by reducing a transfer charge of said transfer body at a discharge position lying in a contact portion where said image carrier and said transfer body contact each other, applying a transfer charge to said transfer body at a position downstream of said discharge position, and transferring the toner image from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then image transfer to said transfer body is effected with the potential of said transfer body being held higher than, in absolute value, said minimum potential inclusive for more than said minimum period of time ΔT inclusive from said discharge position to an end of said contact portion, and with the potential of said transfer body being held lower than a voltage generating a potential difference causative of Paschen discharge between said image carrier and said transfer body at said end.

33. In an image forming apparatus including an image transfer device having a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion, assuming that a minimum potential of said transfer body necessary for toner of the toner image deposited on said image carrier to be electrostatically released toward said transfer body in said contact portion is V1 (V), and that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is ΔT (second), then potential of said transfer body is held higher than, in absolute value, said minimum potential V1 inclusive for more than said minimum period of time ΔT inclusive from said discharge position to an end of said contact portion.

34. An apparatus as claimed in claim 33, wherein said discharging member is connected to ground.

35. An apparatus as claimed in claim 33, wherein a charge opposite in polarity to the transfer charge to be applied by said charging applying member is applied to said discharging member.

36. An apparatus as claimed in claim 33, wherein a portion of said discharging member contacting said transfer body is formed of an elastic material.

37. An apparatus as claimed in claim 36, wherein said discharging member comprises a brush.

38. An apparatus as claimed in claim 33, wherein said image carrier includes a dielectric layer having a thickness dm ranging from 10 to 30 ($\mu$m).

39. An apparatus as claimed in claim 33, wherein toner forming the toner layer on said image carrier has a mean amount of charge q ranging from 2 to 6 (fC) in absolute value for a single toner particle.

40. An apparatus as claimed in claim 33, wherein said transfer body has a surface resistivity Rs between $1\times10^7$ $\Omega/cm^2$ and $1\times10^{10}$ $\Omega/cm^2$ or a volume resistivity Rv between $1\times10^7$ $\Omega$cm and $1\times10^{11}$ $\Omega$cm.

41. In an image forming apparatus including an image transfer device having a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion, assuming that a voltage generating a potential difference causative of Paschen discharge between said image carrier and said transfer body at an end of said contact portion is V2 (V), then the potential of said transfer body at said end is lower than said voltage V2.

42. An apparatus as claimed in claim 41, wherein said discharging member is connected to ground.

43. An apparatus as claimed in claim 41, wherein a charge opposite in polarity to the transfer charge to be applied by said charging applying member is applied to said discharging member.

44. An apparatus as claimed in claim 41, wherein a portion of said discharging member contacting said transfer body is formed of an elastic material.

45. An apparatus as claimed in claim 44, wherein said discharging member comprises a brush.

46. An apparatus as claimed in claim 41, wherein said image carrier includes a dielectric layer having a thickness dm ranging from 10 to 30 ($\mu$m).

47. An apparatus as claimed in claim 41, wherein toner forming the toner layer on said image carrier has a mean amount of charge q ranging from 2 to 6 (fC) in absolute value for a single toner particle.

48. An apparatus as claimed in claim 41, wherein said transfer body has a surface resistivity Rs between $1\times10^7$ $\Omega/cm^2$ and $1\times10^{10}$ $\Omega/cm^2$ or a volume resistivity Rv between $1\times10^7$ $\Omega cm^2$ and $1\times10^{11}$ $\Omega$cm.

49. In an image forming apparatus including an image transfer device having a transfer body movable in contact with, over a preselected distance, a surface of an image carrier carrying a toner image thereon, a discharging member for reducing a transfer charge deposited on said transfer body at a discharge position lying in a contact portion where said image carrier and said transfer body contact each other, and a charging applying member for applying a transfer charge to said transfer body at a position downstream of said discharge position in a direction of movement of said transfer body, the toner image being transferred from said image carrier to said transfer body by an electric field formed in said contact portion; assuming that a minimum potential of said transfer body necessary for toner of the toner image deposited on said image carrier to be electrostatically released toward said transfer body in said contact portion is V1 (V), that a minimum period of time for which a potential of said transfer body should be maintained higher than, in absolute value, said minimum potential V1 inclusive in order to transfer a solid toner image from said image carrier to said transfer body with a transfer efficiency higher than 90% inclusive is $\Delta T$ (second),and that a potential of said transfer body generating a voltage difference causative of Paschen discharge between said image carrier and said transfer body at an end of said contact portion is V2 (V), then the potential of said transfer body is held higher than, in absolute value, said minimum potential inclusive for more than said minimum period of time $\Delta T$ inclusive from said discharge position to said end of said contact portion, and the potential of said transfer body is held lower than said voltage V2 in absolute value at said end.

50. An apparatus as claimed in claim 49, wherein said discharging member is connected to ground.

51. An apparatus as claimed in claim 49, wherein a charge opposite in polarity to the transfer charge to be applied by said charge applying member is applied to said discharging member.

52. An apparatus as claimed in claim 49, wherein a portion of said discharging member contacting said transfer body is formed of an elastic material.

53. An apparatus as claimed in claim 52 wherein said discharging member comprises a brush.

54. An apparatus as claimed in claim 49, wherein said image carrier includes a dielectric layer having a thickness dm ranging from 10 to 30 ($\mu$m).

55. An apparatus as claimed in claim 49, wherein toner forming the toner layer on said image carrier has a mean amount of charge q ranging from 2 to 6 (fC) in absolute value for a single toner particle.

56. An apparatus as claimed in claim 49, wherein said transfer body has a surface resistivity Rs between $1\times10^7$ $\Omega/cm^2$ and $1\times10^{10}$ $\Omega/cm^2$ or a volume resistivity Rv between $1\times10^7$ $\Omega$cm and $1\times10^{11}$ $\Omega$cm.

57. An apparatus as claimed in claim 49, wherein said transfer body comprises a belt having an electric resistance setting up a linear relation between a potential on a rear thereof opposite to a front contacting said image carrier and a distance, as measured on said rear, from said discharge position in the direction of movement of said transfer body, wherein said rear is discharged while the transfer charge is applied to said rear at a position downstream of said end of said contact portion in the direction of movement of said transfer body, and wherein assuming that a distance between said end and a position where the transfer charge is applied is L2 (mm), that said transfer body moves at a speed of A (mm/s), that the potential of a charge applying member is Vt (V), and that a potential of said discharging member is V0 (V), then there is satisfied a relation:

$$|V0+(V1-V0)\cdot(L1+L2)/(L1-A\cdot\Delta T)|\leqq|Vt|<|V0+(V2-V0)\cdot(L1+L2)/L1|.$$

58. An apparatus as claimed in claim 57, wherein said minimum voltage V1 is selected such that an electrostatic force Fe acting on centers of toner particles forming the toner image on said image carrier in such a manner as to pull said toner particles toward said transfer body is greater than 7 nN inclusive.

59. An apparatus as claimed in claim 58, wherein assuming that said image carrier includes a dielectric layer having a thickness dm (μm) and a specific inductive capacity cm, that said transfer body has a thickness dp (μm) and a specific inductive capacity εp, toner particles forming the toner image on said image carrier has a mean amount of charge q (fC) for a single particle, that said toner particles have a mean particle size d(μm), and that said image carrier has a potential VL (V) at an image area thereof, then there is satisfied a relation:

$$|V1| \geqq |\{100+5\cdot(dm-10)\}+(VL+150)|$$

when a dielectric thickness dm/εm of said dielectric layer is 3.1 to 12.5 (μw), a dielectric thickness dp/εp of said transfer body is 1 (μm), a mean amount of charge q/d of the toner particles for a single particle is 0.5 (fC/μm) in absolute value, a toner density δ is 1200 kg/m$^3$, a mean mass m of the toner particles for a single particle is 0.26 ng, a packing ratio P of the toner particles is 0.42, a thickness dt of a toner layer forming the toner image on said image carrier is 20 μm, a specific inductive capacity εγl of the toner layer is 1.6, and a gap g between a surface of the toner layer and a surface of said transfer body is 50 μm.

60. An apparatus as claimed in claim 58, wherein assuming that said image carrier includes a dielectric layer having a thickness dm (μm) and a specific inductive capacity εm, that said transfer body has a thickness dp (εm) and a specific inductive capacity εp, toner particles forming the toner image on said image carrier has a mean amount of charge q (fC) for a single particle, that said toner particles have a mean particle size d(εm), and that said image carrier has a potential VL (V) at an image area thereof, then there is satisfied a relation:

$$|V1| \geqq |\{140+45\cdot(q-2)\}+5\cdot(q-2)^2+(VL+150)|$$

when a dielectric thickness dm/εm of said dielectric layer is 8.8 (μm), a dielectric thickness dp/εp of said transfer body is 1 (μm), a mean amount of charge q/d of the toner particles for a single particle is 0.33 to 1.0 (fC/μm) in absolute value, a toner density δ is 1200 kg/m$^3$, a mean mass m of the toner particles for a single particle is 0.26 ng, a packing ratio P of the toner particles is 0.42, a thickness dt of a toner layer forming the toner image on said image carrier is 20 μm, a specific inductive capacity εγl of the toner layer is 1.6, and a gap g between a surface of the toner layer and a surface of said transfer body is 50 μm.

61. An apparatus as claimed in claim 49, wherein assuming that said image carrier includes a dielectric layer having a thickness dm (μm) and a specific inductive capacity εm, that said transfer body has a thickness of dp (μm) and a specific inductive capacity εp, toner particles forming the toner image on said image carrier has a mean amount of charge q (fC) for a single particle, that said toner particles have a mean particle size d (εm), and that said image carrier has a potential VL (V) at an image area thereof, then there is satisfied a relation:

$$|V2| < |[\{600+10\cdot(dt-5)\}+5\cdot(dm-10)]+VL|$$

when a dielectric thickness dm/εm of said dielectric layer is 3.1 to 12.5 (μm), a dielectric thickness dp/εp of said transfer body is 1 (μm), a mean amount of charge q/d of the toner particles for a single particle is 0.17 to 1.0 (fC/μm) in absolute value, a toner density δ is 1200 kg/m$^3$, a mean mass m of the toner particles for a single particle is 0.26 ng, a packing ratio P of the toner particles is 0.42, a thickness dt of a toner layer forming the toner image on said image carrier is 5 μm to 60 μm, and a specific inductive capacity εγl of the toner layer is 1.6.

62. An apparatus as claimed in claim 61, wherein when said voltages V1 and V2 are respectively 100 (V) and 950 (V), a distance L1 is selected to satisfy a relation:

$$L1 \geqq 0.022 \times A.$$

63. An apparatus as claimed in claim 61, wherein when said voltages V1 and V2 are respectively 200 (V) and 700 (V), a distance L1 is selected to satisfy a relation:

$$L1 > 0.029 \times A.$$

64. An apparatus as claimed in claim 61, wherein said discharging member is connected to ground.

65. An apparatus as claimed in claim 61, wherein a charge opposite in polarity to the transfer charge to be applied by said charging applying member is applied to said discharging member.

66. An apparatus as claimed in claim 61, wherein a portion of said discharging member contacting said transfer body is formed of an elastic material.

67. An apparatus as claimed in claim 66 wherein said discharging member comprises a brush.

68. An apparatus as claimed in claim 61, wherein said image carrier includes a dielectric layer having a thickness dm ranging from 10 to 30 (μm).

69. An apparatus as claimed in claim 61, wherein toner forming the toner layer on said image carrier has a mean amount of charge q ranging from 2 to 6 (fC) in absolute value for a single toner particle.

70. An apparatus as claimed in claim 61, wherein said transfer body has a surface resistivity Rs between $1\times10^7$ Ω/cm$^2$ and $1\times10^{10}$ Ω/cm$^2$ or a volume resistivity Rv between $1\times10^7$ Ωcm and $1\times10^{11}$ Ωcm.

* * * * *